US010443169B2

(12) United States Patent
Ueda et al.

(10) Patent No.: US 10,443,169 B2
(45) Date of Patent: Oct. 15, 2019

(54) SEWING MACHINE

(71) Applicant: BROTHER KOGYO KABUSHIKI KAISHA, Nagoya-shi, Aichi-ken (JP)

(72) Inventors: Daisuke Ueda, Owariasahi (JP); Mitsuhiro Iida, Gifu (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 401 days.

(21) Appl. No.: 15/377,514

(22) Filed: Dec. 13, 2016

(65) Prior Publication Data

US 2017/0088992 A1 Mar. 30, 2017

Related U.S. Application Data

(63) Continuation of application No. PCT/JP2015/084259, filed on Dec. 7, 2015.

(30) Foreign Application Priority Data

Dec. 24, 2014 (JP) ..... 2014-259984

(51) Int. Cl.
*D05B 65/06* (2006.01)
*D05B 87/02* (2006.01)

(52) U.S. Cl.
CPC ..... *D05B 65/06* (2013.01); *D05B 87/02* (2013.01)

(58) Field of Classification Search
CPC ..... D05B 57/02; D05B 65/00; D05B 65/003; D05B 65/02; D05B 65/06
See application file for complete search history.

(56) References Cited

U.S. PATENT DOCUMENTS 5,596,940 A * 1/1997 Yamada ..... D05B 87/02 112/225
2003/0019410 A1* 1/2003 Sano ..... D05B 65/00 112/470.01

(Continued)

FOREIGN PATENT DOCUMENTS

JP H11-019372 A 1/1999
JP 2004-222916 A 8/2004

(Continued)

OTHER PUBLICATIONS

Feb. 23, 2016 International Search Report issued with International Patent Application No. PCT/JP2015/084259.

(Continued)

*Primary Examiner* — Nathan E Durham
(74) *Attorney, Agent, or Firm* — Oliff PLC

(57) ABSTRACT

A sewing machine includes a threading mechanism, a holding member, and a movement mechanism. The threading mechanism is configured to move a hook between a standby position and an operative position. The holding member includes a cutting blade and a clamping portion. The cutting blade is configured to cut an upper thread. The clamping portion is configured to clamp and hold a thread end of the cut upper thread. The movement mechanism is configured to move the holding member to a first position and a second position. The first direction is a direction from the standby position to the operative position. The second position is a position on a second direction side with respect to the first position. The second direction is a direction opposite to the first direction.

11 Claims, 16 Drawing Sheets

(56) References Cited

U.S. PATENT DOCUMENTS

| | | | | |
|---|---|---|---|---|
| 2004/0154502 | A1 | 8/2004 | Noguchi et al. | |
| 2006/0118017 | A1* | 6/2006 | Watanabe | D05B 87/02 112/225 |
| 2007/0209564 | A1 | 9/2007 | Kawaguchi et al. | |
| 2010/0126397 | A1* | 5/2010 | Fujihara | D05B 87/02 112/225 |
| 2015/0013583 | A1* | 1/2015 | Osanai | D05B 65/06 112/302 |

FOREIGN PATENT DOCUMENTS

| | | | |
|---|---|---|---|
| JP | 2007-236510 | A | 9/2007 |
| JP | 2009-153725 | A | 7/2009 |
| JP | 2010-017320 | A | 1/2010 |

OTHER PUBLICATIONS

Jun. 27, 2017 International Preliminary Report on Patentability issued in International Patent Application No. PCT/JP2015/084259.

* cited by examiner

SEWING MACHINE

CROSS-REFERENCE TO RELATED APPLICATION

This application is a continuation application of International Application No. PCT/JP2015/084259, filed Dec. 7, 2015, which claims priority from Japanese Patent Application No. 2014-259984, filed on Dec. 24, 2014. The disclosure of the foregoing application is hereby incorporated by reference in its entirety.

BACKGROUND

The present disclosure relates to a sewing machine.

A sewing machine is known that is provided with a threading mechanism to automatically pass an upper thread through an eye of a sewing needle. When a threading operation is performed using the sewing machine, first, the threading mechanism is operated and a leading end portion of a hook is inserted into the eye of the sewing needle. After that, a user hooks the upper thread on a specific thread hook portion and the leading end portion of the hook, and then uses a holding member to cut and hold a thread end of the upper thread. In this state, the threading mechanism is operated again, and the hook is pulled out from the eye. Thus, the upper thread is caused to pass through the eye. With the above-described sewing machine, it is necessary for the holding member to be in a position where the upper thread is cut such that a length of the upper thread extending from the eye (a length from the eye to the thread end) is a specified length that is not too long but is enough to inhibit the upper thread from slipping out of the eye when sewing is started after the threading. Therefore, the holding member is provided at a position diagonally above and on the near side of the sewing needle of the sewing machine when viewed from the user side.

SUMMARY

With the above-described sewing machine, when the user looks at an area including a needle drop point (hereinafter referred to as a "needle area") of the sewing needle during sewing, the holding member is positioned to the front of the needle area when viewed from the user side. Therefore, there is a possibility that visibility of the needle area may deteriorate.

Various embodiments of the broad principles derived herein provide a sewing machine capable of improving visibility of a needle area.

Embodiments provide a sewing machine that includes a threading mechanism, a holding member, and a movement mechanism. The threading mechanism is configured to move a hook between a standby position before the hook is passed through an eye of a sewing needle and an operative position after the hook is passed through the eye. The hook is configured to pass an upper thread through the eye. The holding member includes a cutting blade and a clamping portion. The cutting blade is configured to cut the upper thread. The clamping portion is configured to clamp and hold a thread end of the cut upper thread. The movement mechanism is configured to move the holding member to a first position and a second position. The first position is a position in which the holding member protrudes in a first direction from an exterior member of the sewing machine and is located diagonally above and on a first direction side of the sewing needle. The first direction is a direction from the standby position to the operative position. The second position is a position on a second direction side with respect to the first position. The second direction is a direction opposite to the first direction.

Embodiments further provide a sewing machine that includes a threading mechanism, a holding member, and a movement mechanism. The threading mechanism is configured to move a hook between a standby position before the hook is passed through an eye of a sewing needle and an operative position after the hook is passed through the eye. The hook is configured to pass an upper thread through the eye. The holding member includes a clamping portion configured to clamp and hold a thread end of the upper thread. The movement mechanism is configured to move the holding member to a first position and a second position. The first position is a position in which the clamping member protrudes in a first direction from an exterior member of the sewing machine. The clamping portion is configured to hold the upper thread when the holding member is in the first position. The second position is a position on a second direction side with respect to the first position. The first direction is a direction from the standby position to the operative position. The second direction is a direction opposite to the first direction.

Embodiments also provide a sewing machine that includes a threading mechanism, a holding member, a movement mechanism, and a single motor. The threading mechanism is configured to move a hook between a standby position before the hook is passed through an eye of a sewing needle and an operative position after the hook is passed through the eye. The hook is configured to pass an upper thread through the eye. The holding member includes a clamping portion configured to clamp and hold a thread end of the upper thread. The movement mechanism is configured to move the holding member to a first position and a second position. A first direction is a direction from the standby position to the operative position. The second position is a position on a second direction side with respect to the first position. The second direction is a direction opposite to the first direction. The single motor is configured to drive the threading mechanism and the movement mechanism.

BRIEF DESCRIPTION OF THE DRAWINGS

Embodiments will be described below in detail with reference to the accompanying drawings in which.

DETAILED DESCRIPTION

Figure 1:
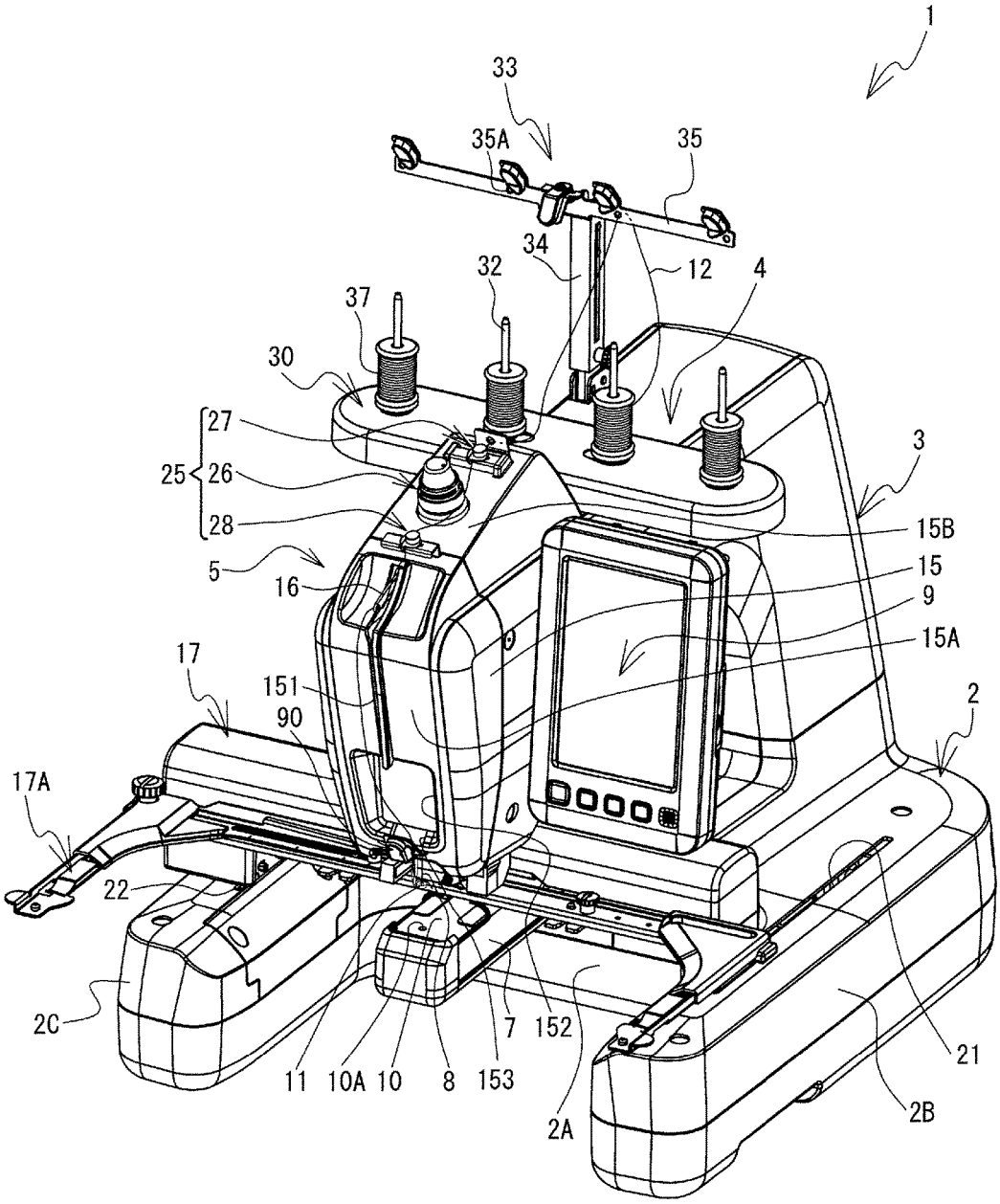
FIG. 1 is a perspective view of a sewing machine.

Hereinafter an embodiment will be explained with reference to the drawings. In the explanation below, the upper side, the lower side, the lower left side, the upper right side, the upper left side, and the lower right side of FIG. 1 are respectively defined as the upper side, the lower side, the front side, the rear side, the left side, and the right side of a sewing machine 1.

The structure of the sewing machine 1 will be explained with reference to FIG. 1 and FIG. 2. As shown in FIG. 1, the sewing machine 1 includes a bed portion 2, a pillar 3, an arm portion 4, a head portion 5, an operation panel 9 and the like. The bed portion 2 is positioned in a lower portion of the sewing machine 1, and supports the whole of the sewing machine 1. The bed portion 2 is formed in a substantially U-shape in a plan view, and includes a main body portion 2A and a pair of leg portions 2B and 2C. The main body portion 2A is positioned at substantially the center of the bed portion 2 in the left-right direction, and is formed in a substantially rectangular plate shape in a plan view. The leg portions 2B and 2C are respectively positioned at a left end portion and a right end portion of the main body portion 2A, and extend further to the front than the front surface of the main body portion 2A such that the leg portions 2B and 2C are substantially parallel to each other.

A cylinder bed 7 is provided at substantially the center of the front surface of the main body portion 2A. The cylinder bed 7 is formed in a substantially square tube shape, and extends to the front. A work cloth (not shown in the drawings) may be placed on an upper surface of the cylinder bed 7. A shuttle mechanism (not shown in the drawings) is provided inside the cylinder bed 7. The shuttle mechanism rotatably drives a shuttle (not shown in the drawings). The shuttle is provided on the leading end side of the cylinder bed 7, and may house a bobbin (not shown in the drawings) on which a lower thread (not shown in the drawings) is wound. Further, a needle plate 10 is provided on an upper surface of the leading end portion of the cylinder bed 7. The needle plate 10 is positioned above the shuttle. A needle hole 10A is provided in the needle plate 10. A sewing needle 8, which will be described below, may be inserted through the needle hole 10A in the up-down direction.

Upper surfaces of the leg portions 2B and 2C are respectively provided with guide grooves 21 and 22, which extend in the front-rear direction. The guide grooves 21 and 22 can guide the movement of a carriage 17 in the front-rear direction. The carriage 17 is formed in a substantially square tube shape, and extends in the left-right direction. The carriage 17 is mounted so as to extend between the leg portions 2B and 2C. The front surface of the carriage 17 is provided with a mounting portion 17A such that the mounting portion 17A can move in the left-right direction. An embroidery frame (not shown in the drawings), which holds the work cloth, can be attached to and removed from the mounting portion 17A. Although not shown in the drawings, a table can be mounted on the leg portions 2B and 2C. When the table is mounted on the leg portions 2B and 2C, the table is disposed so as to extend between the leg portions 2B and 2C. At this time, an upper surface of the table is at substantially the same height as the upper surface of the cylinder bed 7. The work cloth, such as a quilting fabric, may be placed on the upper surface of the table. A movement mechanism (not shown in the drawings), which moves the mounting portion 17A in the left-right direction, is provided inside the carriage 17. Thus, when the sewing machine 1 performs embroidery sewing, the sewing machine 1 can move the embroidery frame back and forth and left and right, as a result of the movement of the carriage 17 in the front-rear direction and the movement of the mounting portion 17A in the left-right direction by the movement mechanism.

The pillar 3 is formed in a substantially square tube shape, and stands on the rear end side of an upper surface of the main body portion 2A. The arm portion 4 extends forward from an upper end portion of the pillar 3 such that the arm portion 4 is opposed to the upper surface of the cylinder bed 7. An upper surface of the arm portion 4 is provided with a flat plate-shaped thread stand 30, which is long in the left-right direction. An upper surface of the thread stand 30 is provided with four thread spool pins 32 at equal intervals. Thread spools 37, around which upper threads 12 are wound, may be rotatably supported by the thread spool pins 32, respectively. A guide member 33 having a T shape in a front view is provided to the rear of the thread stand 30. The guide member 33 includes a rod-shaped columnar support 34 and a guide bar 35. The columnar support 34 stands on the upper surface of the arm portion 4. The guide bar 35 extends in the left-right direction from an upper end portion of the columnar support 34. Four holes 35A, through which the upper threads 12 may be inserted, are provided in the guide bar 35 at equal intervals.

The head portion 5 is provided at a front end portion of the arm portion 4. The head portion 5 is provided with a needle bar case 15 having a substantially cuboid shape. As shown in FIG. 2, a needle bar drive mechanism (not shown in the drawings), a thread take-up mechanism (not shown in the drawings), a threading mechanism 120, a movement mechanism 130, and the like are each provided on the inside of the needle bar case 15. The needle bar drive mechanism is provided on the front side of the head portion 5, and supports a needle bar 6 such that the needle bar 6 can move up and down. The needle bar 6 extends downward from a lower end portion of the head portion 5, and the sewing needle 8 can be detachably mounted on a lower end portion of the needle bar 6. An eye 8A, through which the upper thread 12 may be passed, is formed in the sewing needle 8. In a state in which the sewing needle 8 is mounted on the needle bar 6, the eye 8A is directed in the front-rear direction. As shown in FIG. 2, a presser member 11 having an L shape in a front view is provided to the left of the sewing needle 8. A lower end portion of the presser member 11 is positioned below the lower end (the leading end) of the sewing needle 8, and is provided with a hole (not shown in the drawings), through which the sewing needle 8 can be inserted. A thread holding plate 68 made of a thin flat plate is fixed to a right side surface of the presser member 11. A lower end portion of the thread holding plate 68 is formed in a substantially V shape, and protrudes further to the front than the presser member 11.

As shown in FIG. 1, the thread take-up mechanism causes a thread take-up lever 16 to move up and down in accordance with the up and down movement of the needle bar 6. The thread take-up lever 16 moves up and down along a slit 151 provided in a front surface 15A of the needle bar case 15. The slit 151 is a narrow opening that extends in the up-down direction. When a sewing operation of the sewing machine 1 is performed, the needle bar 6 and the sewing needle 8 operate in cooperation with the shuttle, and cause the upper thread 12 to be entwined with the lower thread pulled out from the bobbin housed in the shuttle. The thread take-up lever 16 pulls the upper thread 12 entwined with the lower thread up onto the needle plate 10. Thus, a stitch is formed on the work cloth.

Figure 2:
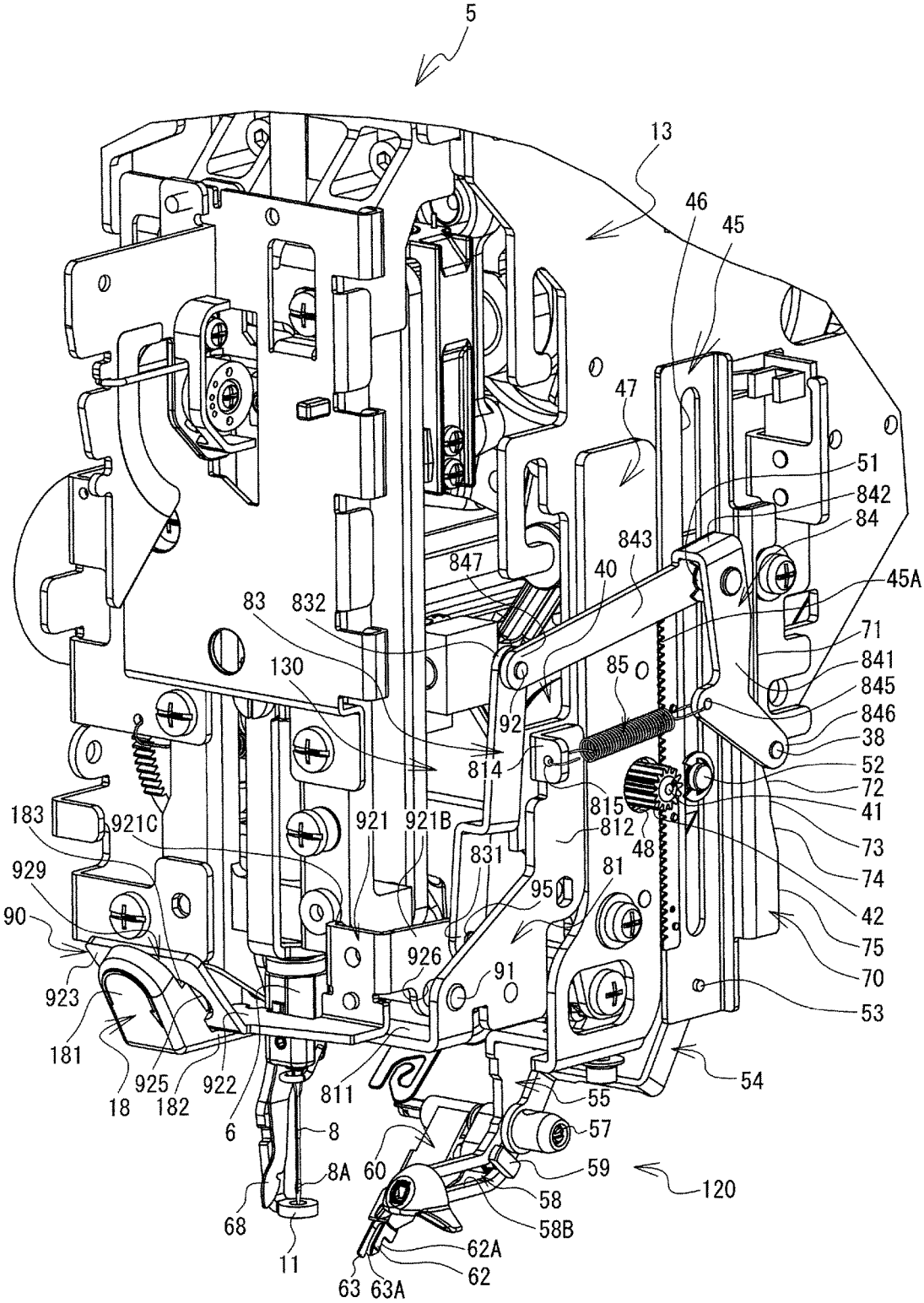
FIG. 2 is a perspective view of a head portion (when a thread holding member is in a lowermost position) when a needle bar case is omitted.
Figure 3:
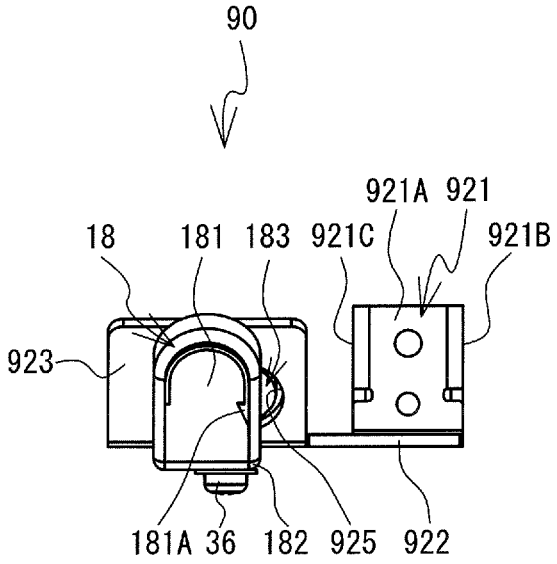
FIG. 3 is a front view of the thread holding member.
Figure 11:
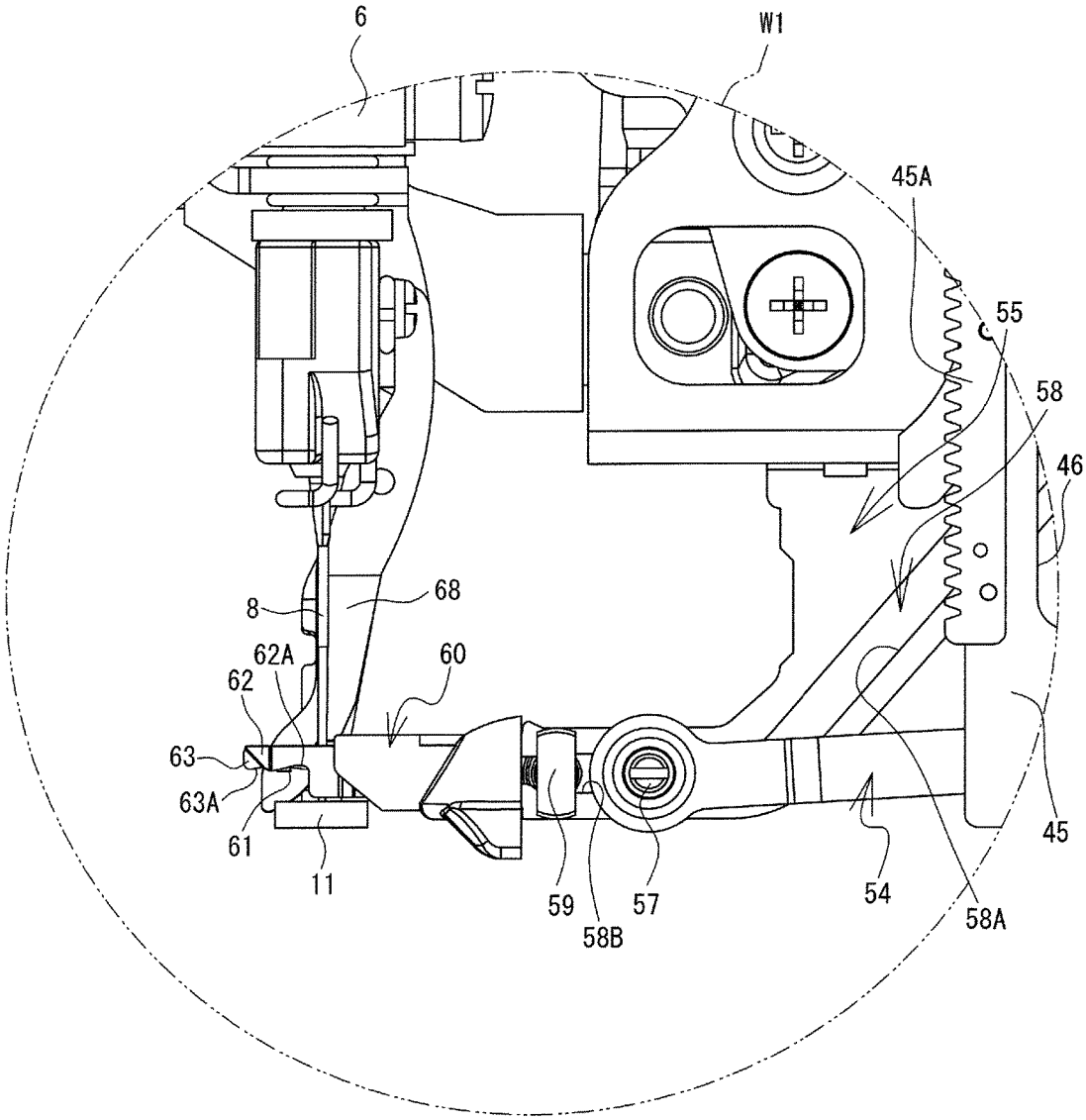
FIG. 11 is a partially enlarged view of an area W1 shown in FIG. 10.

As shown in FIG. 2, the threading mechanism 120 uses a threading hook 61 (refer to FIG. 11), which will be described below, to insert the upper thread 12 through the eye 8A of the sewing needle 8 (hereinafter referred to as "threading"). The movement mechanism 130 supports a thread holding member 90 such that the thread holding member 90 can swing in the front-rear direction, in front of a lower portion of the front surface 15A of the needle bar case 15, and causes the thread holding member 90 to swing in accordance with a threading operation of the threading mechanism 120. The thread holding member 90 is used when the threading is performed by the threading mechanism 120. The thread holding member 90 cuts a free end side of the upper thread 12 hooked on the threading hook 61, and holds the thread end that remains after the cutting. The structure and operation of each of the threading mechanism 120 and the movement mechanism 130 will be described below.

As shown in FIG. 1, a recessed portion 152 is provided in the lower side of the front surface 15A of the needle bar case 15. The recessed portion 152 is formed in a substantially rectangular shape in a front view, and is recessed to the rear. An opening 153 is provided in a substantially central portion of a lower surface on the inside of the recessed portion 152. The opening 153 is a hole portion formed in a substantially rectangular shape in a plan view, and the thread holding member 90 can be inserted through the opening 153. Therefore, on the outside of the needle bar case 15, the movement mechanism 130 can swingably support the thread holding member 90 that passes through the opening 153. As will be described below, the movement mechanism 130 causes the thread holding member 90 to swing rearward, and can thus store the thread holding member 90 on the inside of the recessed portion 152.

An inclined surface 15B is provided on an upper surface of the needle bar case 15. The inclined surface 15B is gently inclined downward from the rear to the front. The inclined surface 15B is provided with a thread tension mechanism 25, which can apply a tension to the upper thread 12. The thread tension mechanism 25 includes a sub-tensioner 27, a main tensioner 26, and a sub-tensioner 28 in that order from an upstream side to a downstream side in a supply direction of the upper thread 12. The main tensioner 26 is internally provided with a rotating disk, and the rotating disk rotates in conjunction with a supply amount of the upper thread 12, thus applying a tension to the upper thread 12. Each of the sub-tensioners 27 and 28 clamps the upper thread 12 using a plate-shaped clamping portion (not shown in the drawings), and thus applies a tension to the upper thread 12.

The operation panel 9 is provided adjacent to the right side of the head portion 5, and includes a liquid crystal display, a touch panel, a start/stop switch, and the like. Various types of information, such as, for example, an operation screen for the user to input a command and a selection screen to select various operation modes of the sewing machine 1 to be described below, can be displayed on the liquid crystal display. The touch panel can receive a command from the user. The start/stop switch is a switch to give a command to start or stop the sewing.

Figure 7:
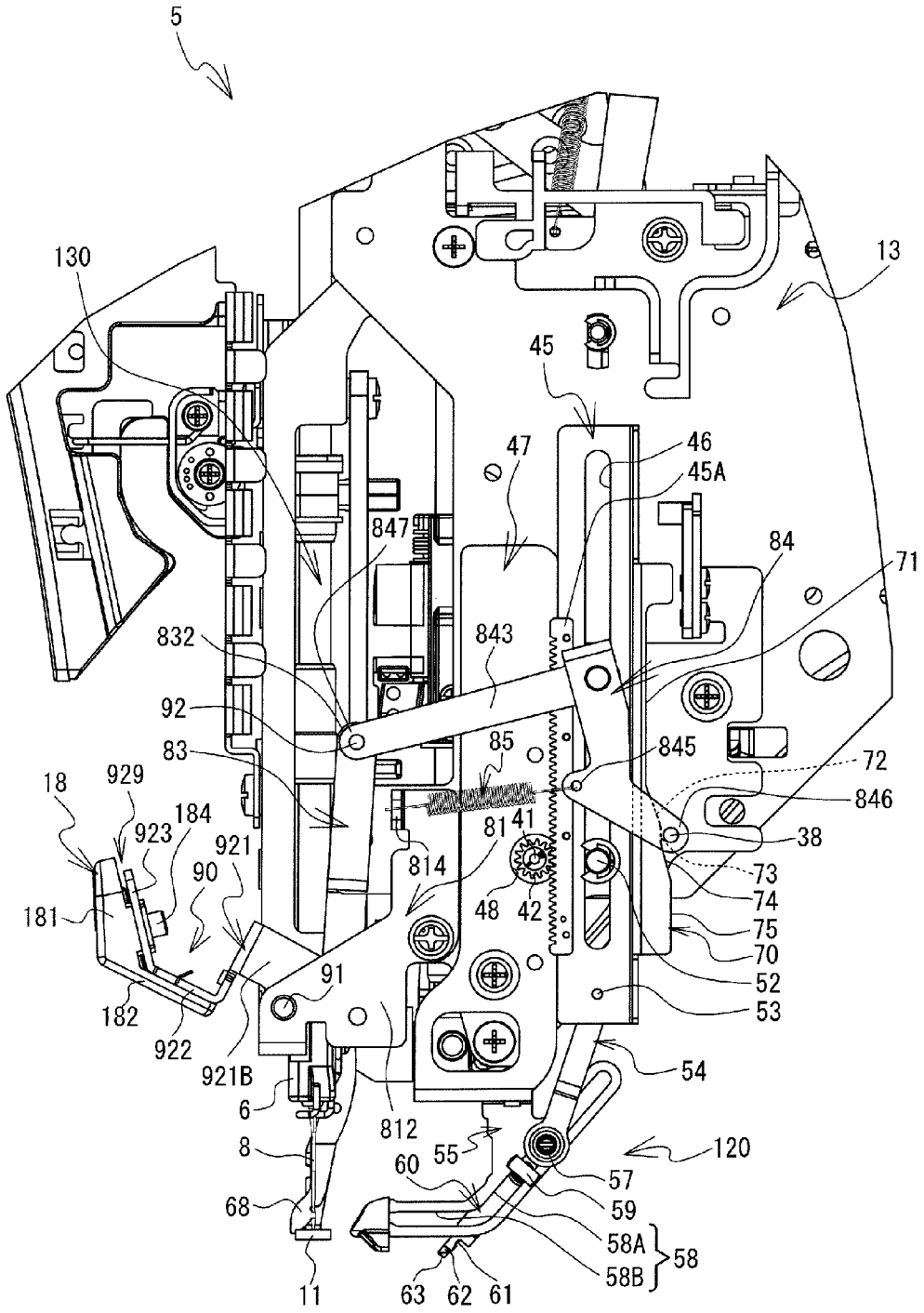
FIG. 7 is a right side view of the head portion (at a normal time) when the needle bar case is omitted.

The structure of the threading mechanism 120 will be explained with reference to FIG. 2 and FIG. 7. The threading mechanism 120 is provided on the lower side of a right side surface of the head portion 5 and to the rear of the sewing needle 8. The threading mechanism 120 includes a threading motor 40, a rack member 45, a crank plate 54, a guide frame 55, and a link block 60. The threading motor 40 is a pulse motor. A sewing machine frame 13 is provided on the right side of the head portion 5. The threading motor 40 is fixed to an inner surface, of the sewing machine frame 13, that faces the needle bar 6 side. An output shaft 41 of the threading motor 40 protrudes to the right via a hole (not shown in the drawings) provided in the sewing machine frame 13 and a hole 48 provided in a plate portion 47 fixed to a right side surface of the sewing machine frame 13. A pinion gear 42 is fixed to a leading end portion of the output shaft 41.

The rack member 45 is formed in a substantially rectangular plate shape that extends in the up-down direction, and is provided adjacent to the rear side of the pinion gear 42. A gear portion 45A provided at a front end portion of the rack member 45 meshes with the pinion gear 42. The rack member 45 is provided with a guide groove 46, which is parallel to its longitudinal direction. The guide groove 46 is engaged with guide pins 51 and 52 fixed to the sewing machine frame 13. The guide pins 51 and 52 are disposed such that the guide pins 51 and 52 are separated from each other in the up-down direction. Thus, the rack member 45 is guided in the up-down direction by the guide groove 46 moving in the up-down direction in a state in which the guide groove 46 is engaged with the guide pins 51 and 52. When the head portion 5 is viewed from the right side, when the output shaft 41 and the pinion gear 42 of the threading motor 40 rotate clockwise, the rack member 45 moves downward. In contrast to this, when the output shaft 41 and the pinion gear 42 rotate counterclockwise, the rack member 45 moves upward.

The guide frame 55 is fixed to a lower portion of the sewing machine frame 13. The guide frame 55 is inclined downward and forward from the lower portion of the sewing machine frame 13, and further, the front end side of the guide frame 55 bends forward and extends substantially horizontally. A front end portion of the guide frame 55 that extends substantially horizontally is positioned to the right of the sewing needle 8 and at substantially the same height as a lower end portion of the sewing needle 8. A guide groove 58 is formed in the guide frame 55. The guide groove 58 includes an inclined portion 58A and a horizontal portion 58B, which accord with the shape of the guide frame 55. A rod-shaped engagement pin 57 is slidably engaged with the guide groove 58. The engagement pin 57 extends in the left-right direction via the guide groove 58, and is coupled to a rear end portion of the link block 60, which will be described below, on the left side of the guide frame 55. Further, on the right side of the guide frame 55, the engagement pin 57 is rotatably coupled to a lower end portion of the crank plate 54, which will be described below. Further, a contact portion 59 is fixed to the front side of the engagement pin 57. The contact portion 59 slides along the guide groove 58 together with the engagement pin 57. The movement of the engagement pin 57 is stopped by causing the contact portion 59 to come into contact with a front end portion of the horizontal portion 58B when the contact portion 59 slides along the guide groove 58 together with the engagement pin 57 and moves in the horizontal portion 58B forward.

The crank plate 54 is disposed between a lower end portion of the rack member 45 and the guide frame 55. When the head portion 5 is viewed from the front, the crank plate 54 is formed by being bent in a substantially Z shape between one end portion and the other end portion in the longitudinal direction of the crank plate 54. The one end portion of the crank plate 54 is rotatably coupled to an inner surface of the lower end portion of the rack member 45 via a shaft support portion 53, and the other end portion is rotatably coupled to the engagement pin 57 on the right side of the guide frame 55.

A rear end portion of the link block 60 is coupled to the engagement pin 57 on the left side of the guide frame 55. The link block 60 is formed in a substantially cuboid shape, and extends in a direction orthogonal to the axial direction of the engagement pin 57, along the shape of the guide frame 55. A pair of left and right thread hook members 62 and 63 (refer to FIG. 11) are provided at a leading end portion of the link block 60. The threading hook 61 (refer to FIG. 11) is provided between the thread hook members 62 and 63. Lower end portions of the thread hook members 62 and 63 are respectively provided with inclined portions 62A and 63A (refer to FIG. 11) that are inclined diagonally upward toward the rear of the link block 60.

By the guide pin 57 sliding from the rear of the guide groove 58 along the inclined portion 58A and the horizontal portion 58B in that order, the link block 60 is first guided obliquely downward and forward, and then guided forward in the horizontal direction. At this time, the leading end portion of the link block 60 moves toward the eye 8A of the sewing needle 8, and the threading hook 61 is inserted through the eye 8A of the sewing needle 8. Then, when the contact portion 59 comes into contact with a front end portion of the guide groove 58, the link block 60 stops together with the engagement pin 57.

The structure of the thread holding member 90 will be explained with reference to FIG. 3 to FIG. 6. The thread holding member 90 includes a shaft-supported portion 921, an extension portion 922, an inclined portion 923, a thread hook portion 18, and a plate spring 19. The shaft-supported portion 921 is formed in a substantially U-groove shape in a plan view (refer to FIG. 4), and includes a front wall 921A, a right side wall 921B, and a left side wall 921C. The front surface of the front wall 921A faces the front side of the sewing machine 1, and is disposed in parallel to the up-down direction. The right side wall 921B and the left side wall 921C respectively extend to the rear from left and right end portions of the front wall 921A.

Figure 5:
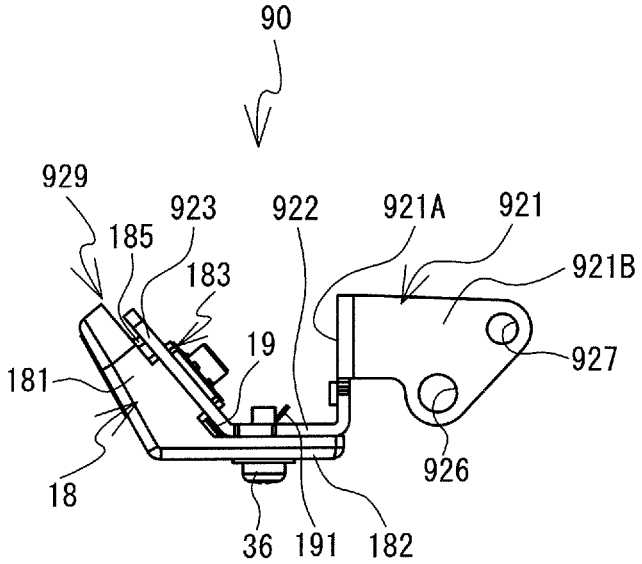
FIG. 5 is a right side view of the thread holding member.
Figure 6:
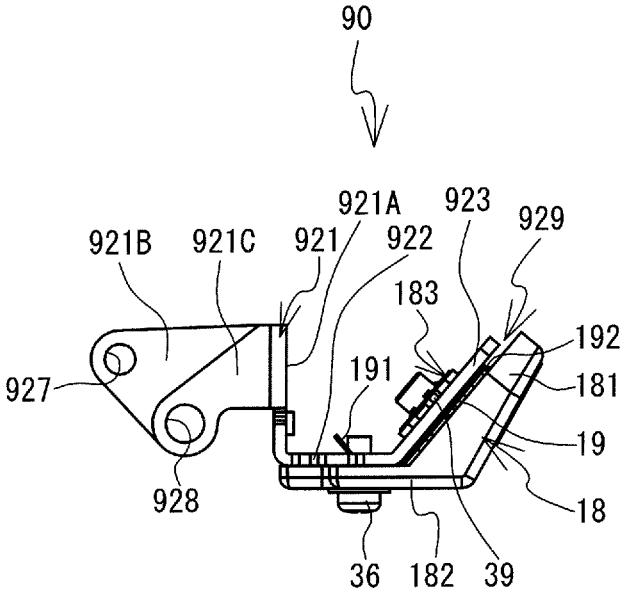
FIG. 6 is a left side view of the thread holding member.

As shown in FIG. 5, a rear end portion of the right side wall 921B is inclined toward the front wall 921A from the upper side to the lower side. A circular hole 926 is provided in the vicinity of a lower portion of the rear end portion, and a circular hole 927 is provided in the vicinity of an upper portion of the rear end portion. As shown in FIG. 6, the length of the left side wall 921C in the front-rear direction is substantially two thirds of the length of the right side wall 921B in the front-rear direction. A circular hole 928 is provided in a rear end portion of the left side wall 921C. The hole 926 and the hole 928 are disposed coaxially with each other in the left-right direction.

Figure 4:
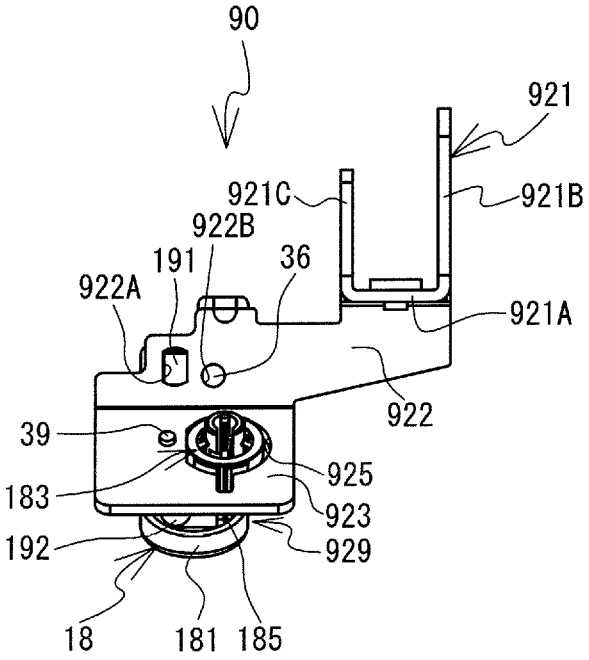
FIG. 4 is a plan view of the thread holding member.

As shown in FIG. 4, the extension portion 922 extends diagonally leftward and forward in a substantially horizontal plane, from a lower end portion of the front wall 921A of the shaft-supported portion 921. A substantially rectangular locking hole 922A is provided in the vicinity of a front end portion of the extension portion 922. A locking end portion 191 of the plate spring 19, which will be described below, is inserted through the locking hole 922A from a lower surface side of the extension portion 922 and is locked to an upper surface side. Further, a circular fixing hole 922B is provided to the right of the locking hole 922A. A screw 36 used to fix the thread hook portion 18, which will be described below, to the extension portion 922 is screwed into the fixing hole 922B. The inclined portion 923 extends from the front end portion of the extension portion 922 such that it is inclined diagonally upward with respect to the front side. A substantially circular fixing hole 925 is provided slightly to the right of the substantial center of the inclined portion 923 (refer to FIG. 3 and FIG. 4). A cutting blade support portion 183, which will be described below, of the thread hook portion 18 is engaged with the fixing hole 925.

The thread hook portion 18 is made of a resin, for example, and is formed substantially in an L shape in a right side view (refer to FIG. 5). The thread hook portion 18 includes a main body portion 181 and a horizontal portion 182. The main body portion 181 is formed in a substantially rectangular plate shape in a front view, and the upper end side of the main body portion 181 is inclined to the front. An upper end portion of the main body portion 181 is formed in a substantially arc shape. An arrow mark 181A is formed on the front surface of the main body portion 181 (refer to FIG. 3). The mark 181A indicates a direction in which the upper thread 12 is hooked on the thread hook portion 18. The cutting blade support portion 183, which has a substantially cylindrical shape, stands on the rear surface side of the main body portion 181, slightly to the right of a substantially central portion. The cutting blade support portion 183 supports a cutting blade 185 toward the upper end side of the thread hook portion 18. The cutting blade support portion 183 engages with the fixing hole 925 provided in the inclined portion 923. The horizontal portion 182 is formed in a substantially rectangular plate shape in a plan view, and extends to the rear from a lower end portion of the main body portion 181. A fixing hole (not shown in the drawings) to fix the horizontal portion 182 to the lower surface of the extension portion 922 using the screw 36 is provided at substantially the center of the horizontal portion 182. The fixing hole is disposed corresponding to the fixing hole 922B provided in the extension portion 922 of the thread holding member 90.

The plate spring 19 is formed in a long plate shape, and is attached along the lower surface of the extension portion 922 and the front surface of the inclined portion 923. Both end portions in the longitudinal direction of the plate spring 19 are provided with the locking end portion 191 and a clamping end portion 192, and a substantially central portion of the plate spring 19 is fixed by a fixing pin 39 (refer to FIG. 4), slightly to the left of a substantially central portion of the front surface of the inclined portion 923. The locking end portion 191 is inserted through the locking hole 922A, which is provided in the extension portion 922, from the lower surface side of the extension portion 922, and is locked to the upper surface side. On the other hand, the clamping end portion 192 is disposed on the left side of a leading end portion of the cutting blade 185, which is disposed in the vicinity of an upper portion of the extension portion 922. The leading end of the clamping end portion 192 is formed in a substantially arc shape.

Then, the thread hook portion 18 is attached, from the lower front side, such that the main body portion 181 and the horizontal portion 182 of the thread hook portion 18 cover the inclined portion 923 and the extension portion 922, to which the plate spring 19 is attached. The main body portion 181 is disposed on the front surface of the inclined portion 923. The cutting blade support portion 183 engages with the fixing hole 925 provided in the inclined portion 923. On the other hand, the horizontal portion 182 is disposed on the lower surface of the extension portion 922. The screw 36 is screwed into the fixing hole of the horizontal portion 182 and the fixing hole 922B of the extension portion 922.

Then, as shown in FIG. 4 to FIG. 6, a gap 929 is formed between the upper end portion of the main body portion 181 of the thread hook portion 18 and an upper end portion of the inclined portion 923 of the thread holding member 90. In the gap 929, the leading end portion of the cutting blade 185 is disposed on the right side and the clamping end portion 192 of the plate spring 19 is disposed on the left side (refer to FIG. 4). The user may thread the upper thread 12 into the gap 929 from the left side in accordance with the mark 181A provided on the front surface of the main body portion 181 of the thread hook portion 18, and may pull down the upper thread 12 in a state in which the upper thread 12 is hooked onto the thread hook portion 18. At this time, the free end side of the upper thread 12 is clamped between the clamping end portion 192 of the plate spring 19 and the front surface of the inclined portion 923, and at the same time, is cut by the cutting blade 185 on the right side of the clamping end portion 192. In this manner, at the same time as the free end side of the upper thread 12 is cut, the thread end that remains as a result of the cutting is held by the clamping end portion 192 of the plate spring 19.

The structure of the movement mechanism 130 will be explained with reference to FIG. 2 and FIG. 7. The movement mechanism 130 is provided on the lower side of the right side surface of the head portion 5, and supports the thread holding member 90 such that the thread holding member 90 can swing in the front-rear direction, in front of the front surface 15A of the needle bar case 15. The movement mechanism 130 includes a main body member 81, a first link member 83, a second link member 84, a cam portion 70, and a coil spring 85, and uses the threading motor 40 (refer to FIG. 2) of the threading mechanism 120, as a common drive source.

As shown in FIG. 2, the main body member 81 is formed in a substantially U shape in a front view, and is fixed to the lower portion of the sewing machine frame 13 provided on the head portion 5. The main body member 81 includes a bottom wall 811, a right side wall 812, and a left side wall (not shown in the drawings). The bottom wall 811 is disposed adjacent to the rear side of the needle bar 6, and is formed in a substantially rectangular shape in a plan view. The right side wall 812 stands on a right end portion of the bottom wall 811, and extends to a position higher than the pinion gear 42. Then, a rod-shaped support shaft 91 extends in the left-right direction between a lower portion on the front end side of the right side wall 812 and a lower portion on the front end side of the left side wall. A plate-shaped protruding piece 814, which protrudes to the right, is provided on an upper portion of a front end portion of the right side wall 812. A circular spring locking hole 815 is provided in the protruding piece 814.

On the inside of the main body member 81 structured as described above, the shaft-supported portion 921 of the thread holding member 90 is disposed such that the inner side that is open is directed to the rear. The support shaft 91 is inserted through the hole 926 (refer to FIG. 5) provided in the right side wall 921B of the shaft-supported portion 921 and the hole 928 (refer to FIG. 6) provided in the left side wall 921C. Thus, the thread holding member 90 is supported such that the thread holding member 90 can rotate around the support shaft 91 of the main body member 81.

When the head portion 5 is viewed from the front, the first link member 83 extends in the up-down direction, and is formed by being bent in a substantially crank shape between one end portion and the other end portion in the longitudinal direction of the first link member 83. A lower end portion 831 of the first link member 83 is rotatably coupled, via a shaft support pin 95 (refer to FIG. 2), to the hole 927 (refer to FIG. 5) provided in the right side wall 921B of the shaft-supported portion 921 of the thread holding member 90. On the other hand, an upper end portion 832 of the first link member 83 is rotatably coupled, via a shaft support pin 92, to a front end portion 847 of a forward extending portion 843, which will be described below, of the second link member 84.

The second link member 84 is disposed between the upper end portion 832 of the first link member 83 and the cam portion 70 (which will be described below), which is provided on the rear end side of the rack member 45. The second link member 84 is formed such that a substantially central portion in the longitudinal direction of the second link member 84 is bent upward substantially in an L shape. The second link member 84 includes a rearward extending portion 841, a bent portion 842, and the forward extending portion 843. The rearward extending portion 841 is formed substantially in an L shape such that its substantially central portion in the longitudinal direction is bent so as to protrude to the front. The bent portion 842 is folded back, at substantially a right angle, to the left from a front end portion of the rearward extending portion 841, and is coupled to an upper portion of the rear end side of the forward extending portion 843. The forward extending portion 843 is coupled to a left end portion of the bent portion 842, and extends such that the forward extending portion 843 is inclined diagonally downward with respect to the front side.

A slide pin 38 is provided at a rear end portion of the rearward extending portion 841, in a posture in which the axial direction of the slide pin 38 is the left-right direction. Although not shown in detail in the drawings, the leading end of the slide pin 38 protrudes to the left from the rearward extending portion 841. The slide pin 38 comes into contact with a cam surface (which will be described below) of the cam portion 70 that moves up and down together with the rack member 45, and slides along the cam surface. A spring locking hole 845 is provided in the vicinity of a front end portion of the substantially central portion of the rearward extending portion 841. A rear end portion of the forward extending portion 843 is rotatably coupled to a guide pin 51, which is provided on the sewing machine frame 13.

The cam portion 70 is provided on a rear end portion of the rack member 45. The cam portion 70 includes the cam surface that is directed rearward. The cam surface includes a first cam surface 71, a second cam surface 72, a third cam surface 73, a fourth cam surface 74, and a fifth cam surface 75 in that order from the upper side to the lower side. If it is defined that the thickness of the cam portion 70 in the front-rear direction is the height of the cam surface, the first cam surface 71 is the lowest surface and the fifth cam surface 75 is the highest surface. The first cam surface 71, the third cam surface 73, and the fifth cam surface 75 are flat surfaces that are parallel to each other in the up-down direction. The second cam surface 72 and the fourth cam surface 74 are inclined surfaces that connect the cam surfaces. The first cam surface 71 is formed in an area from an upper end portion of the cam surface to a substantially central portion in the longitudinal direction of the cam surface, and the second cam surface 72, the third cam surface 73, the fourth cam surface 74, and the fifth cam surface 75 are formed in a remaining area below the aforementioned area. The slide pin 38, which is provided at a rear end portion 846 of the second link member 84, slides with respect to the cam surface formed in this manner.

One end portion of the coil spring 85 is locked into the spring locking hole 815, which is provided in the protruding piece 814 of the right side wall 812 of the main body member 81, and the other end portion is locked into the spring locking hole 845, which is provided in the substantially central portion of the rearward extending portion 841 of the second link member 84. The position of the main body member 81 is fixed to a lower portion of the head portion 5. Therefore, the coil spring 85 constantly urges the substantially central portion of the rearward extending portion 841 of the second link member 84 toward the main body member 81. On the other hand, since the second link member 84 is axially supported such that the second link member 84 can swing around the guide pin 51, the second link member 84 is constantly urged clockwise in a right side view. As a result, the slide pin 38 is constantly pressed against the cam surface of the cam portion 70.

Next, operation modes of the sewing machine 1 will be explained. The user may select the operation mode of the sewing machine 1 using a selection screen displayed on the operation panel 9. The operation modes include, for example, an embroidery sewing mode and a free motion mode. The embroidery sewing mode is a mode in which embroidery sewing is performed while automatically moving the embroidery frame, which holds the work cloth, back and forth and left and right with respect to the sewing needle 8 that moves up and down. The embroidery frame is mounted on the mounting portion 17A of the carriage 17. In the embroidery sewing mode, after completion of the sewing, the upper thread 12 and the lower thread may be cut by a thread cutting mechanism (not shown in the drawings) provided inside the sewing machine 1, either automatically or when a specified operation is performed by the user.

On the other hand, in the free motion mode, sewing is performed while the user moves the work cloth manually without using the embroidery frame. For example, when quilting sewing is performed, the user may select the free motion mode on the operation panel 9. When the free motion mode is selected on the operation panel 9, the carriage 17 moves to the rear. In this state, the user may mount a table (not shown in the drawings) on the leg portions 2B and 2C, and may place the work cloth on the table. The user can perform the quilting sewing by manually moving the work cloth on the table with respect to the sewing needle 8 that moves up and down.

When sewing is performed in the free motion mode, the user may manually move the work cloth while looking down at a needle area, which is an area including the sewing needle 8, from the front side of the head portion 5, and may proceed with the sewing while carefully looking at the stitches formed on the work cloth. Therefore, in the free motion mode, the visibility of the needle area is particularly important. As shown in FIG. 1, in the sewing machine 1, the thread holding member 90 is disposed to the front of the front surface 15A of the needle bar case 15. For example, if the thread holding member 90 is positioned along the user's line of sight to the needle area (refer to FIG. 12), it is difficult to see the needle area. In the sewing machine 1 of the present embodiment, at a normal time when the free motion mode is selected and the threading mechanism 120 is not driven, the movement mechanism 130 swings the thread holding member 90 to the rear, as will be described below. Thus, the visibility when the user looks at the needle area can be secured. When the threading mechanism 120 is driven and threading is performed, the movement mechanism 130 swings the thread holding member 90 to the front, and stops the thread holding member 90 at an optimal position to cut and hold the upper thread 12.

A threading operation of the threading mechanism 120 and an operation of the movement mechanism 130 performed in conjunction with the threading operation will be specifically explained with reference to FIG. 7 to FIG. 12. In the present embodiment, first, the threading operation of the threading mechanism 120 will be explained, and then, the operation of the movement mechanism 130 will be explained in conjunction with the threading operation.

The threading operation of the threading mechanism 120 can be performed in either the embroidery sewing mode or the free motion mode. As shown in FIG. 7, in a preparation stage before the sewing operation of the sewing machine 1, the engagement pin 57 is positioned to the rear of the guide groove 58. Therefore, the link block 60 is positioned to the rear of the lower portion of the head portion 5. The threading hook 61 is disposed in a standby position.

Figure 9:
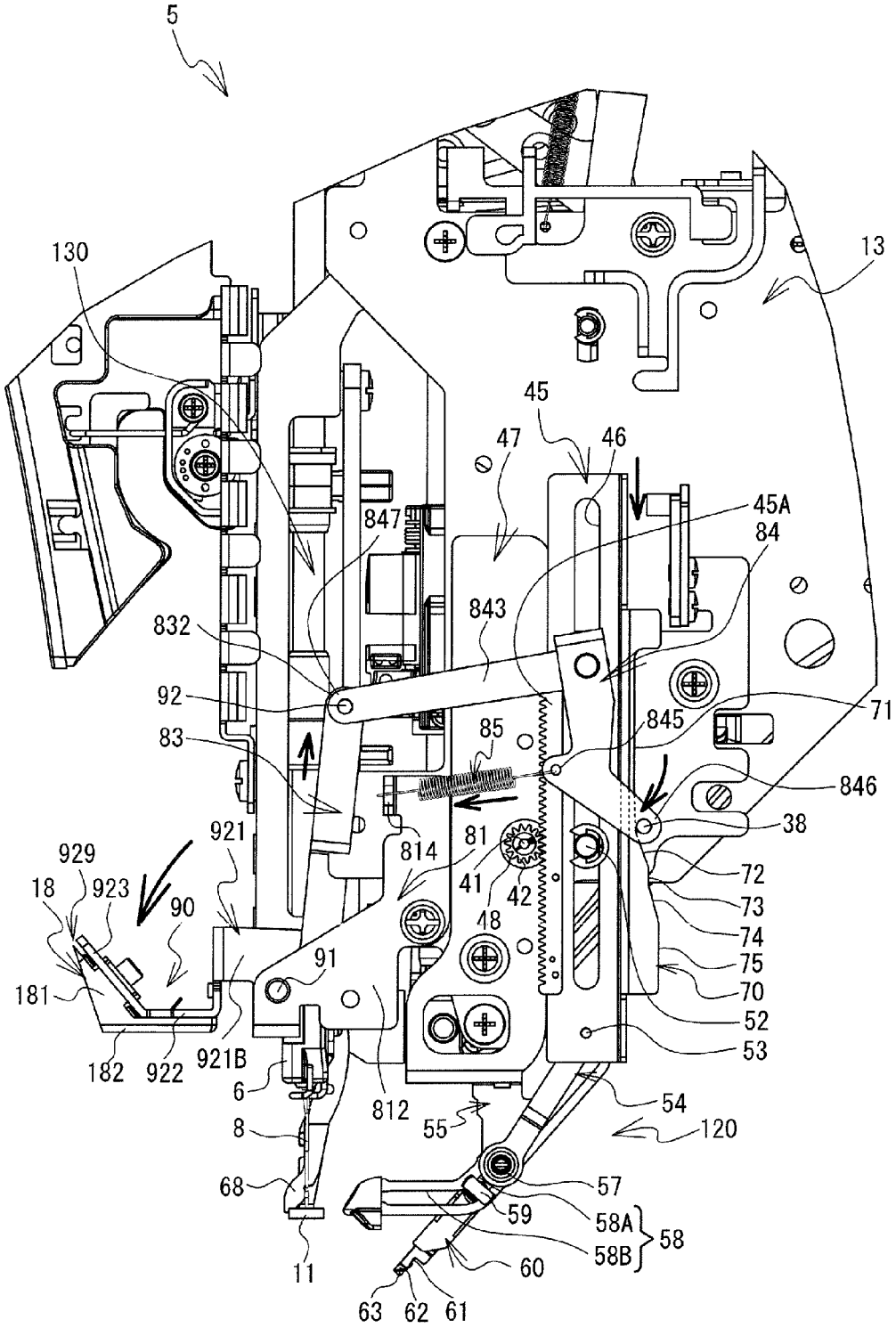
FIG. 9 is a right side view of the head portion (when the thread holding member is in the lowermost position) when the needle bar case is omitted.
Figure 10:
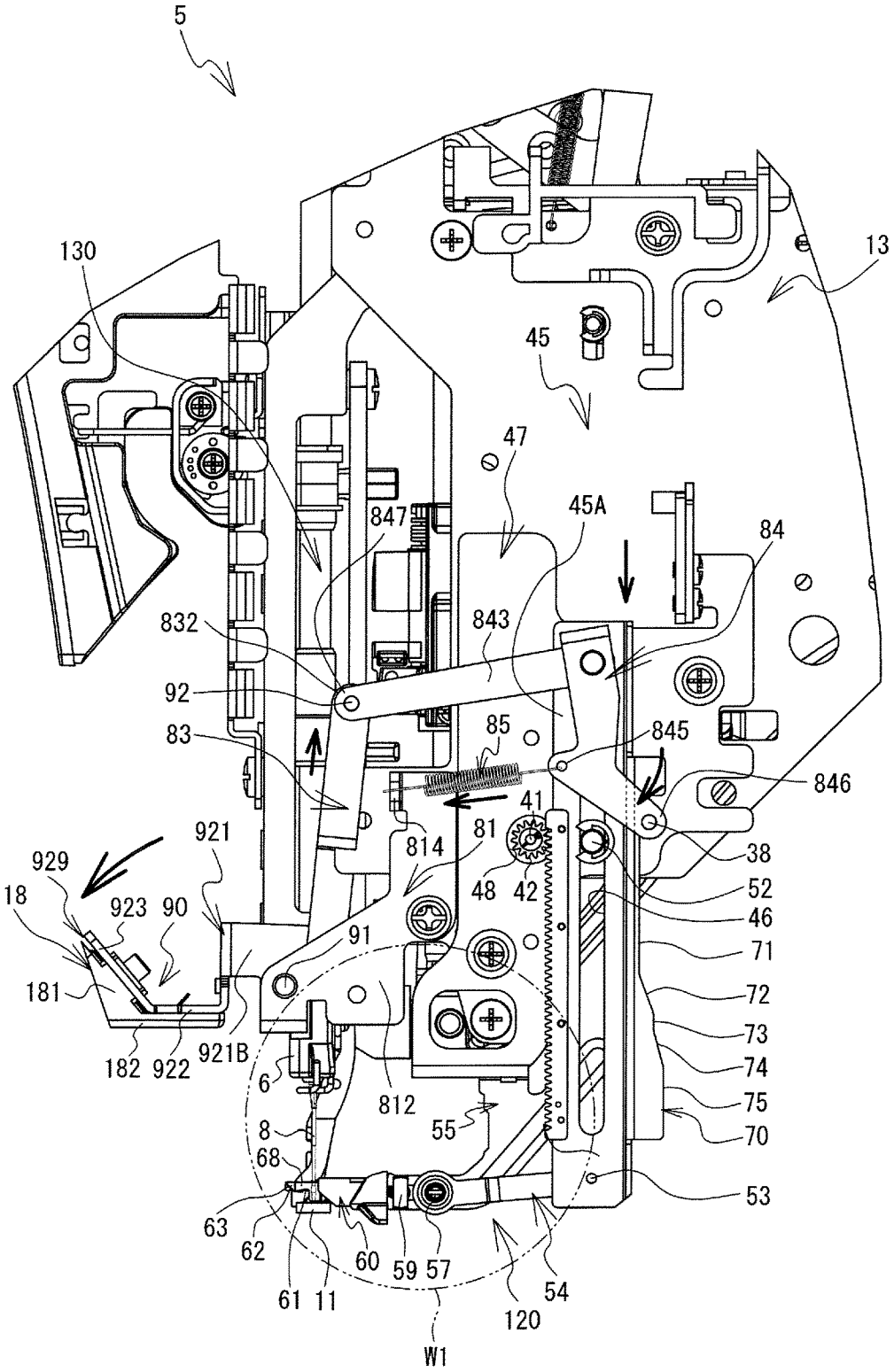
FIG. 10 is a right side view of the head portion (at a time of threading) when the needle bar case is omitted.

When the user presses a threading switch (not shown in the drawings) displayed on the operation panel 9, the threading motor 40 (refer to FIG. 2) rotates in the forward direction, and the pinion gear 42 rotates clockwise in a right side view together with the output shaft 41. In response to this, the rack member 45 is guided by the guide pins 51 and 52 and moves downward, as shown in FIG. 9 and FIG. 10. The other end portion of the crank plate 54, whose one end portion is coupled to the lower end portion of the rack member 45 via the shaft support portion 53, pushes down the engagement pin 57. As a result, the engagement pin 57 slides over the inclined portion 58A and the horizontal portion 58B, in that order, along the guide groove 58. In accordance with this, the link block 60 moves diagonally downward and forward along the inclined portion 58A, and then moves forward in the horizontal direction along the horizontal portion 58B (refer to FIG. 10). The threading hook 61 is disposed in the standby position when the link block 60 can move in the horizontal direction and the threading hook 61 is not inserted through the eye 8A of the sewing needle 8. Then, when the contact portion 59 comes into contact with the front end portion of the horizontal portion 58B, the link block 60 stops. The threading hook 61 is disposed in an operative position where the threading hook 61 is inserted through the eye 8A (refer to FIG. 11). The sewing machine 1 stops the drive of the threading motor 40.

At this time, as will be described below, the movement mechanism 130 is also driven. Therefore, the thread holding member 90 swings forward from above, and is pulled out significantly. Thus, the thread holding member 90 is moved to a lowermost position. The lowermost position is a position in which the thread holding member 90 is pulled out, as much as possible, to the front and below the lower portion of the head portion 5. The lowermost position is set to a position in which the upper thread 12 can be cut by the cutting blade 185 provided in the thread hook portion 18, and in which the upper thread 12 is cut such that a length of the upper thread 12 extending from the eye 8A of the sewing needle 8 (a thread end length from the eye 8A) is a specified length that is not too long but is enough to inhibit the upper thread 12 from slipping out of the eye 8A when sewing is started after the threading operation.

Next, the user may hook the upper thread 12 supplied from the thread tension mechanism 25 via the thread take-up lever 16 onto the thread hook member 62, the threading hook 61, the thread hook member 63, and the lower end portion of the thread holding plate 68 in that order from the right to the left, and may thread the upper thread 12 into the gap 929 of the thread holding member 90 from the left side. Then, the user may hook the upper thread 12 onto the thread hook portion 18, and may pull down the upper thread 12. Thus, the free end side of the upper thread 12 is cut and at the same time, the thread end that remains as a result of the cutting is held by the plate spring 19. Further, when the user presses the threading switch displayed on the operation panel 9 once again, the threading motor 40 is driven in the reverse direction and the threading hook 61 moves to the rear. The threading motor 40 stops at a point in time at which the threading hook 61 has moved to a specified position where the threading hook 61 slips out of the eye 8A and moves rearward away from the eye 8A. At this time, a thread loop having a loop shape is formed between the eye 8A and the threading hook 61.

Next, in order to remove the thread loop, another drive motor (not shown in the drawings) for driving a thread pulling member (not shown in the drawings) is driven. The thread pulling member is driven and moved diagonally downward and forward, and a leading end portion of the thread pulling member hooks the thread loop. After that, when the thread pulling member is moved upward to an original rear position by the drive motor, the free end side of the thread loop held between the threading hook 61 and the eye 8A is pulled and disengaged from the threading hook 61. In this manner, a state is achieved in which the upper thread 12 completely passes through the eye 8A. After that, the threading motor 40 is driven in the reverse direction, the threading hook 61 is returned to the original position, and the threading is complete.

Next, a swing operation of the movement mechanism 130 will be explained.

A Case in which the Free Motion Mode is Selected (Normal Time)

Figure 8:
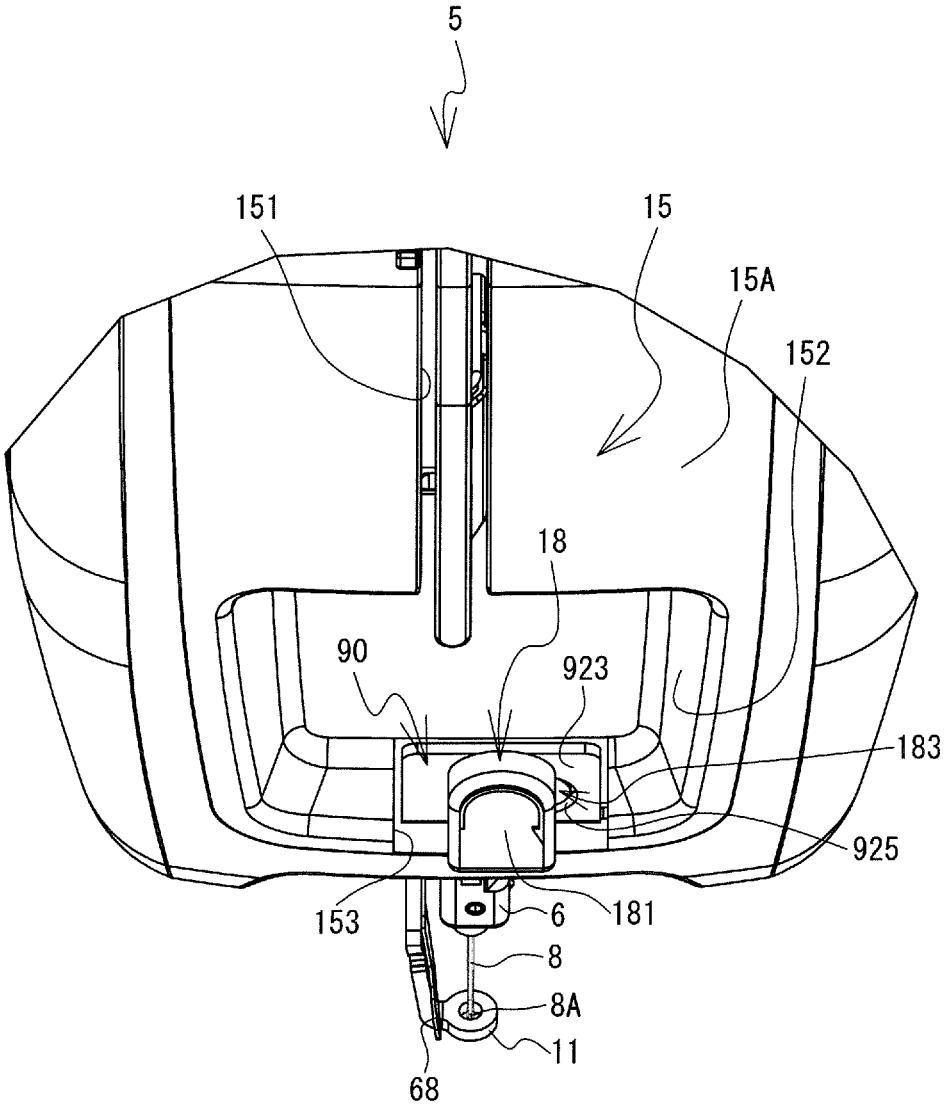
FIG. 8 is a front view of the lower side of the needle bar case (at the normal time)

When the free motion mode is selected on the operation panel 9, a control portion (not shown in the drawings) of the sewing machine 1 drives the threading motor 40 so that the slide pin 38 is positioned on the third cam surface 73 of the cam portion 70, and the rack member 45 moves up and down. In a state in which the slide pin 38 is positioned on the third cam surface 73, the forward extending portion 843 of the second link member 84 depresses the first link member 83 downward. Therefore, the thread holding member 90 is stopped at a position where the thread holding member 90 has swung clockwise in a right side view around the support shaft 91 from the lowermost position (refer to FIG. 10). As a result, the thread holding member 90 is disposed at a retracted position where the thread holding member 90 has swung upward and rearward from the lowermost position. The front surface of the main body portion 181 of the thread hook portion 18 is substantially parallel to the up-down direction. In this state, as shown in FIG. 8, if the user looks down at the needle area from the front side of the head portion 5, the thread holding member 90 is positioned rearward with respect to the user's line of sight to the needle area. Thus, at the normal time when the free motion mode is selected, the visibility of the needle area when viewed from the user can be improved.

Further, in the free motion mode, after the completion of the sewing, normally, the user may pull out the work cloth to the near side and may carefully cut the upper thread 12 and the lower thread connected to the stitch formed on the work cloth, using scissors or the like. In order to pull out the work cloth to the near side, the user may release the tension applied to the upper thread 12 using the thread tension mechanism 25. When the free motion mode is selected, since the thread holding member 90 has swung to the retracted position, an operation space can be secured in front of the sewing needle 8. As a result, the work cloth can be easily pulled out to the near side without being obstructed by the thread holding member 90.

Although not described in detail in the present embodiment, when the embroidery sewing mode is selected, in a similar manner to when the free motion mode is selected, the thread holding member 90 may be moved to the retracted position, or may be disposed in the lowermost position as shown in FIG. 9.

Threading

Next, when the user presses the threading switch (not shown in the drawings) displayed on the operation panel 9 in order to perform the threading before the sewing operation of the sewing machine 1, the threading motor 40 (refer to FIG. 2) rotates in the forward direction and the pinion gear 42 rotates clockwise in a right side view together with the output shaft 41. In response to this, the rack member 45 moves downward while being guided by the guide pins 51 and 52, as shown in FIG. 9 and FIG. 10. The cam portion 70 moves downward together with the rack member 45. The slide pin 38 slides over the third cam surface 73, the second cam surface 72, and the first cam surface 71, in that order. In accordance with this, the slide pin 38 is moved forward in a stepwise manner. As a result, the second link member 84 swings clockwise in a right side view around the guide pin 51. Therefore, the forward extending portion 843 of the second link member 84 pulls the first link member 83 upward. The thread holding member 90 swings counterclockwise in a right side view around the support shaft 91. The threading motor 40 stops. As a result, the thread holding member 90 stops at the lowermost position. The inclined portion 923 of the thread holding member 90 tilts forward, and the extension portion 922 becomes substantially horizontal.

Figure 12:
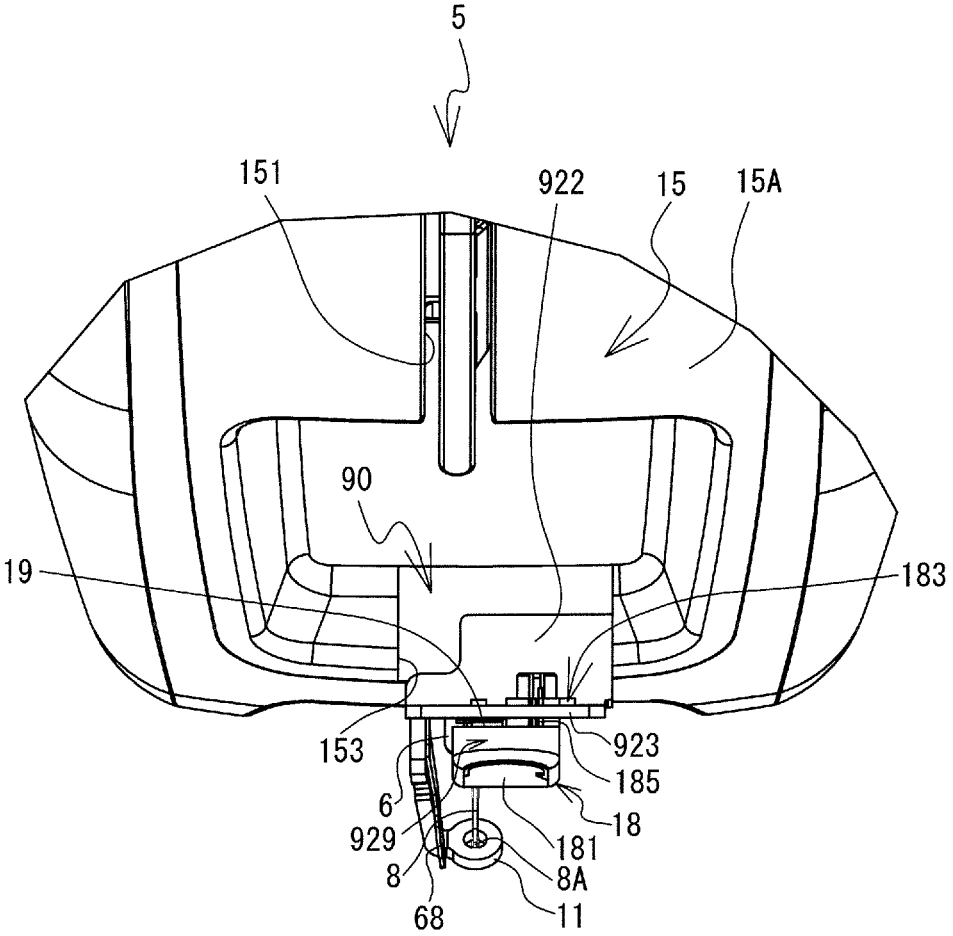
FIG. 12 is a front view of the lower side of the needle bar case (when the thread holding member is in the lowermost position)

As shown in FIG. 10 and FIG. 12, the thread holding member 90 disposed in the lowermost position is pulled out significantly to the front of the front surface 15A of the needle bar case 15. In this state, the gap 929 on the leading end side of the thread holding member 90 tilts forward and can be easily seen by the user. Thus, operability can be improved when the upper thread 12 is passed through the gap 929 and hooked onto the thread hook portion 18. Further, it is possible to cause the thread holding member 90 disposed in the lowermost position to cut the upper thread 12 at the specified length that is not too long but is enough to inhibit the upper thread 12 from slipping out of the eye 8A of the sewing needle 8 when sewing is started after the threading operation, and to hold the thread end after the cutting.

Storage

Figure 13:
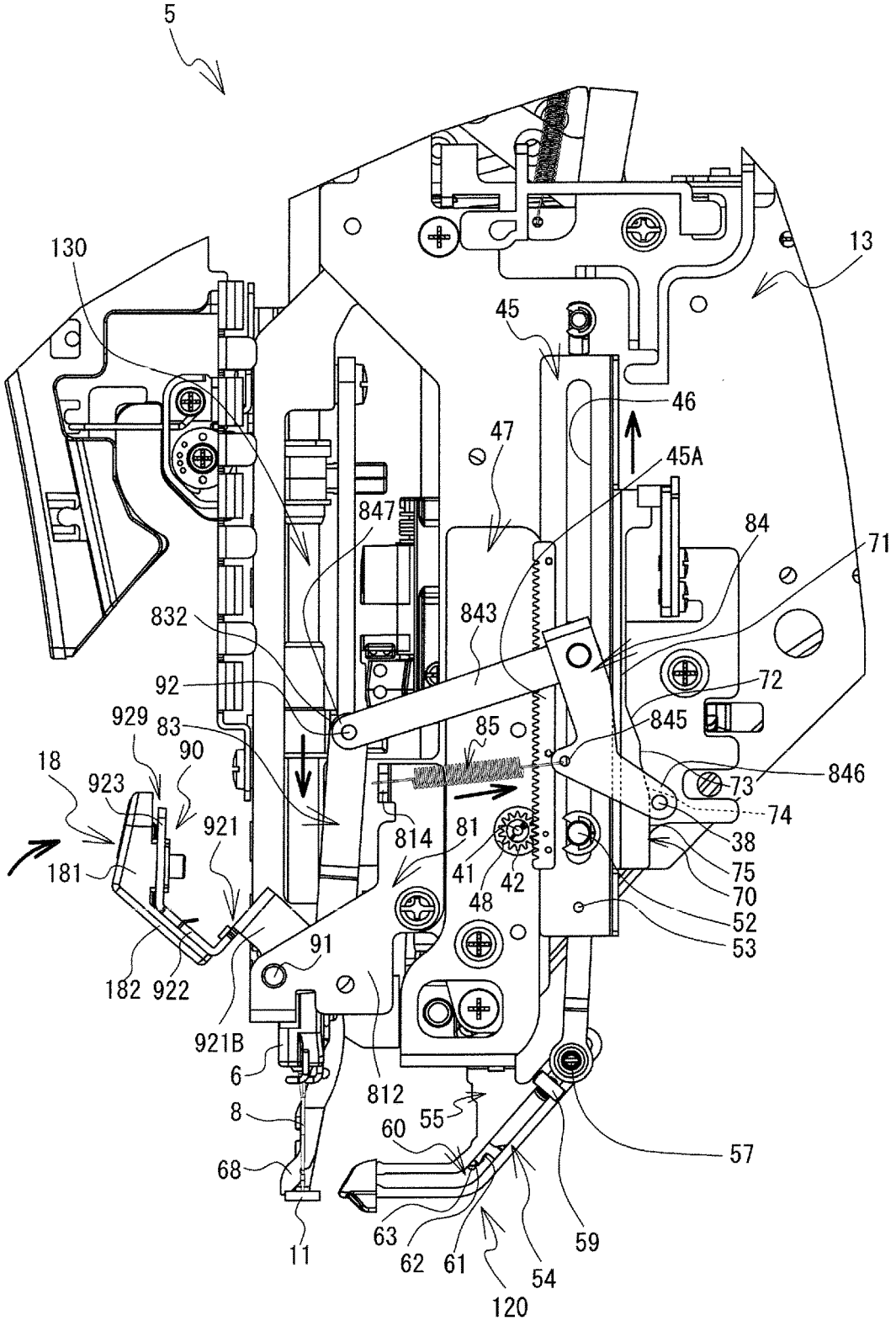
FIG. 13 is a right side view of the head portion (when the thread holding member is in a storage position) when the needle bar case is omitted.

In the sewing machine 1, the thread holding member 90 can be caused to swing further rearward from the retracted position, and can be stored inside the recessed portion 152 of the needle bar case 15. For example, in a state in which the thread holding member 90 is in the retracted position, if the user presses a storage switch (not shown in the drawings) displayed on the operation panel 9, the threading motor 40 (refer to FIG. 2) is driven in the reverse direction and the pinion gear 42 rotates counterclockwise in a right side view together with the output shaft 41, as shown in FIG. 13. In response to this, the rack member 45 moves upward while being guided by the guide pins 51 and 52. The cam portion 70 moves upward together with the rack member 45. The slide pin 38 slides over the third cam surface 73, the fourth cam surface 74, and the fifth cam surface 75, in that order. In accordance with this, the slide pin 38 is moved further to the rear, and thus, the second link member 84 swings counterclockwise in a right side view around the guide pin 51. Therefore, the forward extending portion 843 of the second link member 84 further depresses the first link member 83 downward. The thread holding member 90 further swings clockwise in a right side view around the support shaft 91. The threading motor 40 stops. Thus, the thread holding member 90 stops at a storage position on the inside of the recessed portion 152.

Figure 14:
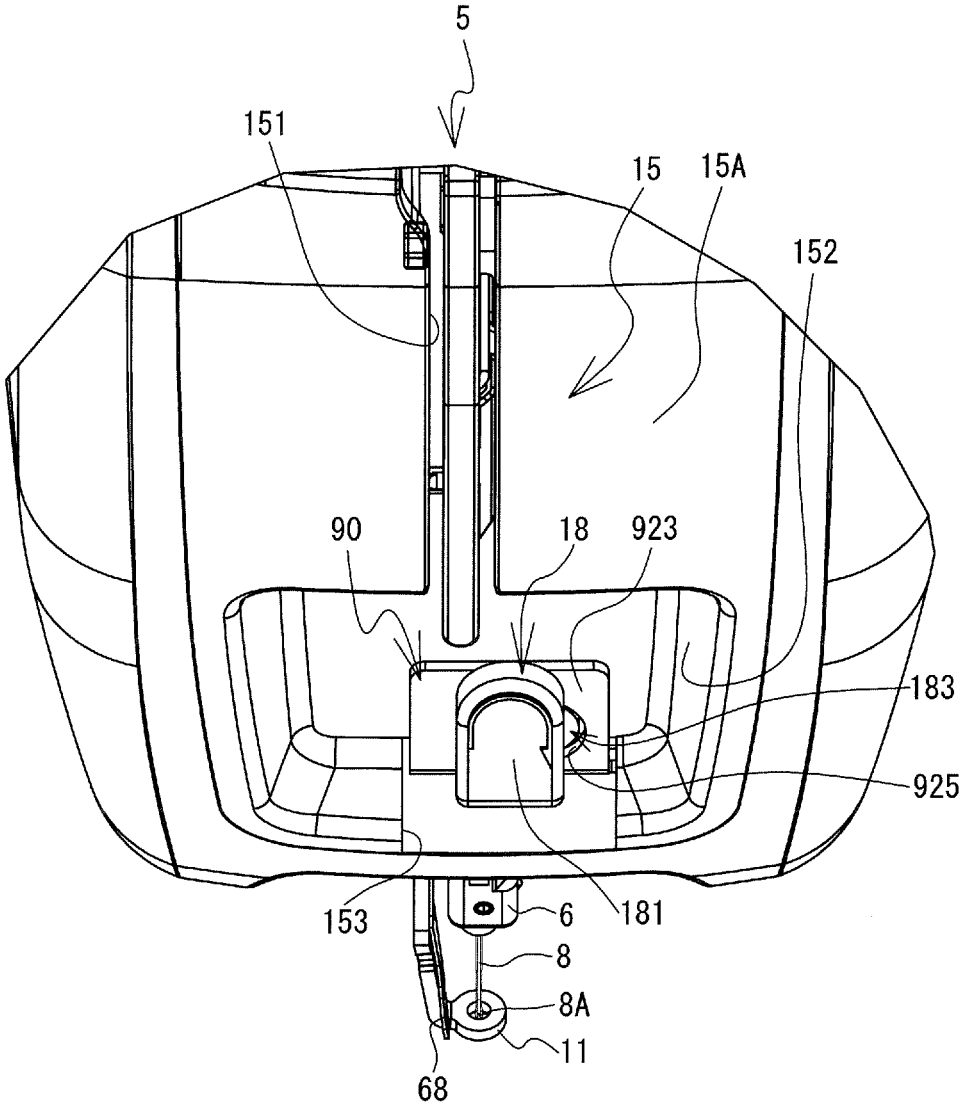
FIG. 14 is a front view of the lower side of the needle bar case (when the thread holding member is in the storage position)
Figure 15:
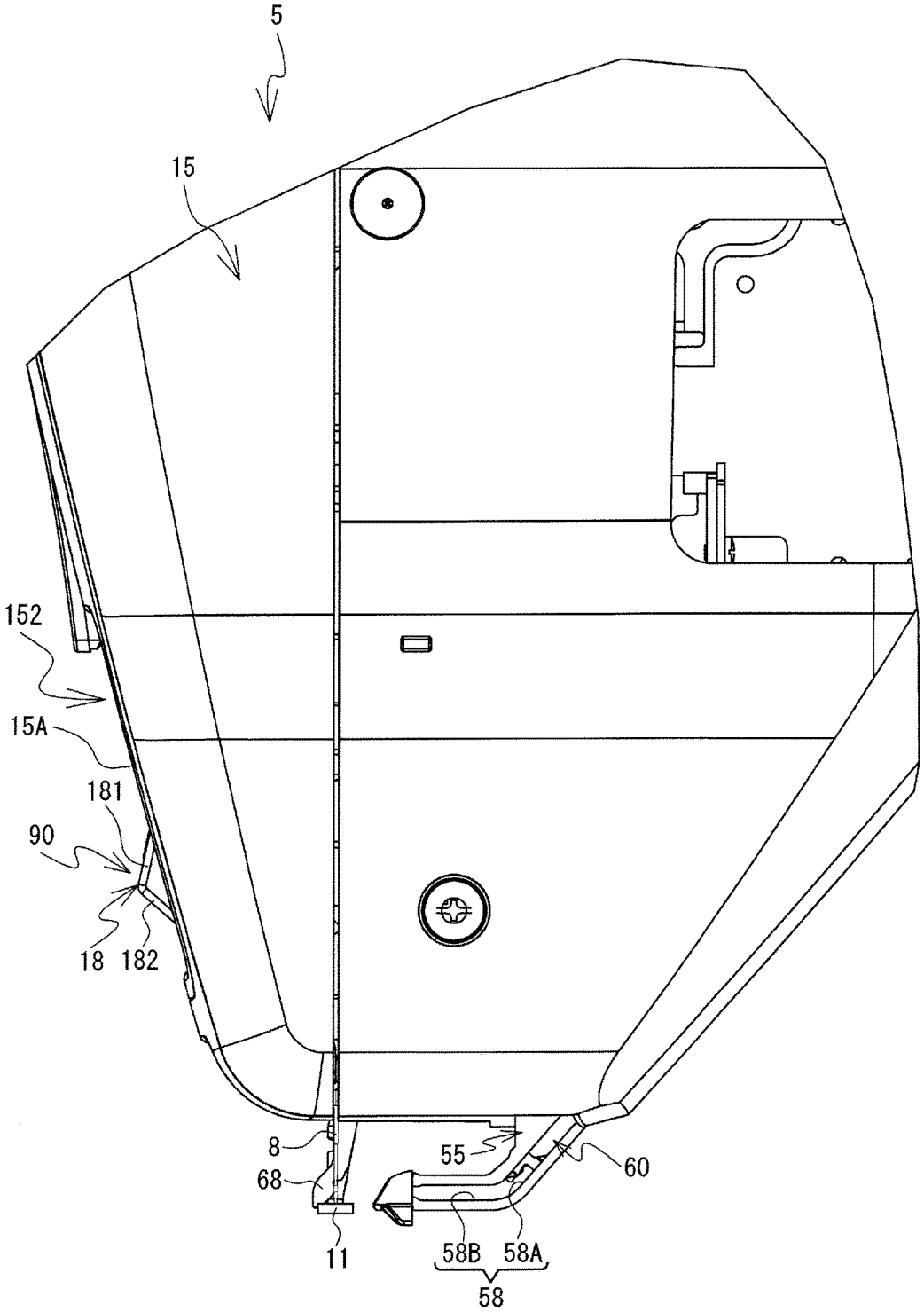
FIG. 15 is a right side view of the lower side of the needle bar case (when the thread holding member is in the storage position)

As shown in FIG. 14 and FIG. 15, since the thread holding member 90 is stored inside the recessed portion 152, the thread holding member 90 does not protrude forward from the front surface 15A of the needle bar case 15. Thus, for example, when the sewing machine 1 is moved, conveyed, or stored, it is possible to avoid a situation in which the thread holding member 90 erroneously collides with another object and is deformed. Further, since the periphery of the front surface 15A of the needle bar case 15 is neat and gives a beautiful impression, the appearance of the sewing machine 1 can also be improved.

As described above, the sewing machine 1 of the present embodiment can swing the thread holding member 90 in three steps, i.e., the lowermost position, the retracted position, and the storage position. Further, the threading motor 40 that drives the threading mechanism 120 is used as the drive source of the movement mechanism 130 that causes the thread holding member 90 to swing. When the threading mechanism 120 is driven, it is necessary for the sewing machine 1 to drive the movement mechanism 130. Therefore, by using the common threading motor 40, the swing operation of the thread holding member 90 can be synchronized with the threading operation in a favorable manner. Further, since the movement mechanism 130 is driven by the threading motor 40 of the threading mechanism 120, there is no need to attach an additional motor. Therefore, there is no need to provide a space for attaching the additional motor in the head portion 5, and a cost for the additional motor is not incurred.

As explained above, the sewing machine 1 of the present embodiment includes the threading mechanism 120. The threading mechanism 120 moves the threading hook 61 used to pass the upper thread 12 through the eye 8A of the sewing needle 8, between the standby position before the hook 61 is passed through the eye 8A and the operative position after the hook 61 has been passed through the eye 8A. The threading mechanism 120 is driven by the threading motor 40. The sewing machine 1 further includes the thread holding member 90 and the movement mechanism 130. The thread holding member 90 includes the cutting blade 185 used to cut the upper thread 12, and the plate spring 19 that clamps and holds the thread end of the cut upper thread 12. The movement mechanism 130 moves the thread holding member 90 to the lowermost position and the retracted position. The lowermost position is a position where the thread holding member 90 protrudes to the front from the needle bar case 15 of the sewing machine 1 and is located diagonally above and to the front of the sewing needle 8, and is a position where the upper thread 12 can be cut by the cutting blade 185. The lowermost position may be a position where the clamping end portion 192 of the thread holding member 90 protrudes forward from the needle bar case 15 of the sewing machine 1 and where the clamping end portion 129 can hold the upper thread 12. The retracted position is a position to the rear of the lowermost position. For example, when the threading is performed by the threading mechanism 120, the movement mechanism 130 moves the thread holding member 90 to the lowermost position. As a result, as viewed by the user who works in front of the sewing machine 1, the thread holding member 90 is disposed on the near side. Therefore, the upper thread 12 can be cut at an optimal position using the cutting blade 185 of the thread holding member 90, and further, the thread end of the cut upper thread 12 can be easily held by the plate spring 19. In contrast to this, at the normal time when the threading is not performed, by moving the thread holding member 90 to the retracted position, the thread holding member 90 moves rearward away from the line of sight of the user toward the needle area. It is therefore possible to improve the visibility of the needle area on the work cloth during sewing, for example.

Further, in the present embodiment, the threading motor 40 is the drive source that drives each of the threading mechanism 120 and the movement mechanism 130. Thus, the swing operation of the thread holding member 90 can be synchronized with the threading operation of the threading mechanism 120 in a favorable manner. Further, there is no need to attach an additional motor in order to operate the movement mechanism 130. Therefore, there is no need to provide a space for attaching the additional motor in the head portion 5, and the cost to attach the additional motor is not incurred.

Further, in the present embodiment, the movement mechanism 130 moves the thread holding member 90 from the retracted position to the lowermost position in conjunction with the forward movement of the threading hook 61. Therefore, the user can cut the upper thread 12 using the thread holding member 90 that has moved to the lowermost position, and can cause the holding member 90 to hold the thread end of the cut upper thread 12. Further, the thread holding member 90 is moved from the lowermost position to the retracted position in conjunction with the rearward movement of the threading hook 61. Next, the user may hook the upper thread 12 on the threading hook 61 that exits from the eye 8A, and the threading hook 61 moves to the rear. As a result, the upper thread 12 can be passed through the eye 8A. At this time, the thread holding member 90 moves to the retracted position. Therefore, when the sewing operation is performed subsequently, the thread holding member 90 is not an obstruction to the user's line of sight to the needle area.

Further, in the present embodiment, one of the embroidery sewing mode and the free motion mode can be selected as the operation mode of the sewing machine 1. When the free motion mode is selected, the movement mechanism 130 moves the thread holding member 90 to the retracted position. The free motion mode is selected when, for example, quilting sewing is performed. In the quilting sewing, since the user manually moves the work cloth, the user may perform the sewing operation while looking at the needle area more carefully in comparison to when the embroidery sewing mode is selected. At this time, since the movement mechanism 130 moves the thread holding member 90 to the retracted position, the thread holding member 90 is not an obstruction to the user's line of sight to the needle area. Thus, the user can favorably perform the sewing operation in the free motion mode. Further, the operation space can be secured in front of the sewing needle 8. As a result, the work cloth can be easily pulled out to the near side without being obstructed by the thread holding member 90.

Further, in the present embodiment, a leading end portion of the thread holding member 90 is provided with the cutting blade 185 and the clamping end portion 192 of the plate spring 19, and the shaft-supported portion 921 on the opposite side to the leading end portion is swingably supported with respect to the main body member 81 fixed to the sewing machine frame 13, which is a part of a machine frame. Therefore, the movement mechanism 130 can significantly swing the cutting blade 185 and the clamping end portion 192 of the plate spring 19 provided on the leading end portion, between the lowermost position and the retracted position, with only a small swinging movement around the shaft-supported portion 921.

Further, in the present embodiment, in addition to the lowermost position and the retracted position, the movement mechanism 130 can swing the thread holding member 90 to the storage position, which is a position further to the rear than the retracted position and which is inside the recessed portion 152 provided in the front surface 15A of the needle bar case 15. In the storage position, the thread holding member 90 does not protrude forward from the front surface 15A of the needle bar case 15. It is thus possible to avoid a situation in which the thread holding member 90 erroneously collides with another object and is deformed. Further, since the thread holding member 90 is stored inside the recessed portion 152, it is possible to improve the appearance of the sewing machine 1.

Various changes may be made to the above-described embodiment. For example, although the movement mechanism 130 of the above-described embodiment causes the thread holding member 90 to swing between the lowermost position, the retracted position, and the storage position by the drive of the threading motor 40, the thread holding member 90 may be swung manually, for example.

Figure 16:
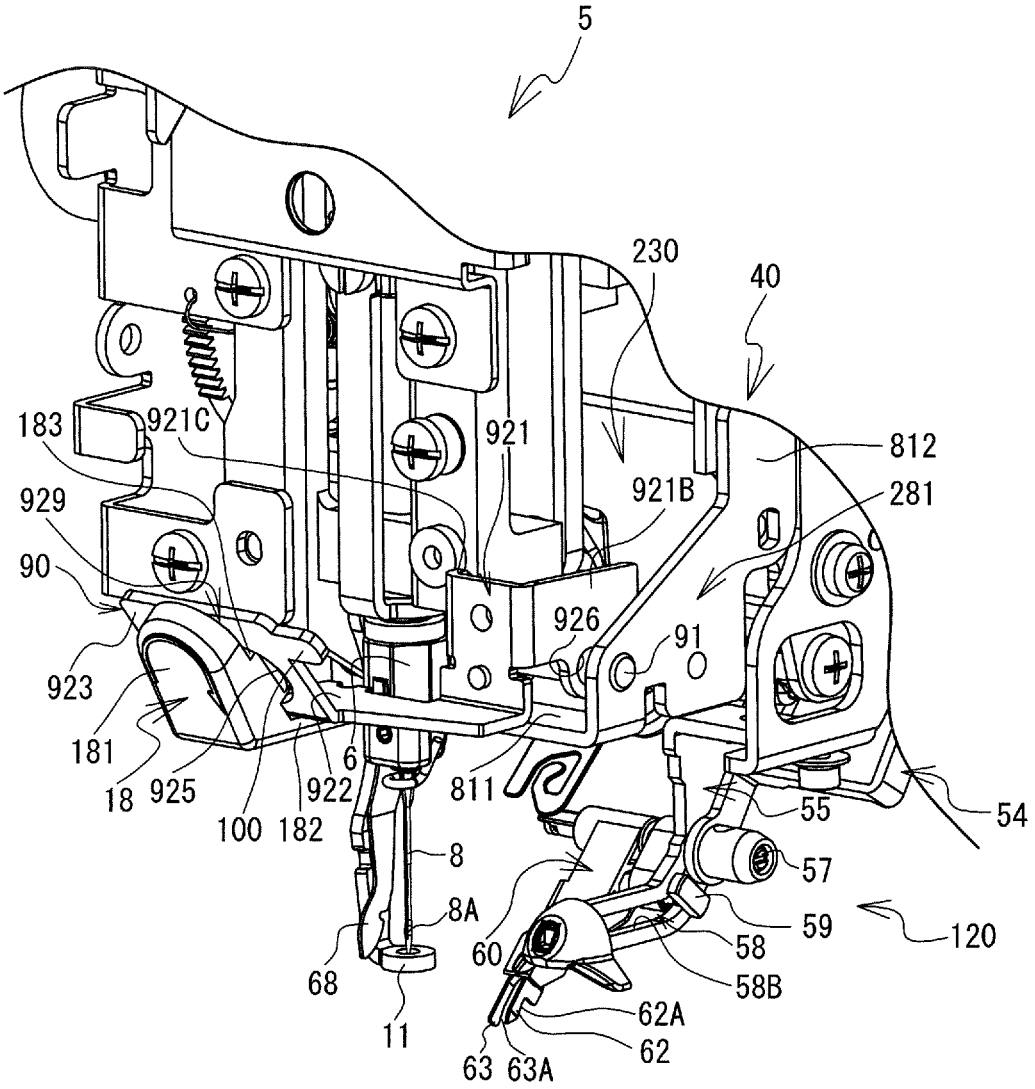
FIG. 16 is a perspective view of the head portion provided with a movement mechanism according to a modified example.

As shown in a modified example shown in FIG. 16, a movement mechanism 230 according to a modified example of the above-described embodiment may be provided in the head portion 5 of a sewing machine. The movement mechanism 230 is a mechanism that allows the thread holding member 90 to be manually swung in the front-rear direction. The movement mechanism 230 includes a main body member 281 and an operation lever 100. The main body member 281 has substantially the same structure as the main body member 81 of the movement mechanism 130 according to the above-described embodiment, and swingably supports the shaft-supported portion 921 of the thread holding member 90 via the support shaft 91. The operation lever 100 protrudes to the right from an upper portion of a right end portion of the inclined portion 923 of the thread holding member 90. The user can swing the thread holding member 90 by manually swinging the operation lever 100 in the front-rear direction. It is sufficient that a section of the shaft-supported portion 921 that is axially supported by the support shaft 91 is provided with, for example, a corrugated spring washer (not shown in the drawings) so that a friction force is generated by the corrugated spring washer, and the thread holding member 90 is held in the lowermost position, the retracted position, or the storage position. Further, although not shown in the drawings, the shaft-supported portion 921 of the thread holding member 90 may be configured to be supported by a free stop hinge that can stop at any angle. That the position in which the operation lever 100 is provided is not limited to the position shown in FIG. 16. Further, various modifications can be made to the shape and the orientation of the operation lever 100.

Further, although the movement mechanism 130 of the above-described embodiment causes the thread holding member 90 to swing in the three steps, i.e., the lowermost position, the retracted position and the storage position, the movement mechanism 130 may cause the thread holding member 90 to swing in two steps, i.e., the lowermost position, and the retracted position. In this case, it is sufficient that the cam surface of the cam portion 70 provided on the rack member 45 has two steps and, for example, the fourth cam surface 74 and the fifth cam surface 75 may be omitted from the cam surface. Alternatively, the thread holding member 90 may be caused to swing in two steps, i.e., the lowermost position and the storage position. In this case, the second cam surface 72 and the third cam surface 73 may be omitted from the cam surface of the cam portion 70.

Further, although the sewing machine 1 of the above-described embodiment is a single needle sewing machine, another type of sewing machine, such as a multi-needle sewing machine, may be used. Further, although the sewing machine 1 is an embroidery dedicated machine and includes the carriage 17 that movably holds the embroidery frame, a sewing machine that does not include a carriage may be used. Further, the number of the thread spools 37 on the thread stand 30, the number of the holes 35A provided in the guide member 33, and the like, may be physically one or a plural number, and changes in arrangement may be made as appropriate. The thread stand 30 and the guide member 33 can be changed in shape, as appropriate.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a threading mechanism configured to move a hook between a standby position before the hook is passed through an eye of a sewing needle and an operative position after the hook is passed through the eye, the hook being configured to pass an upper thread through the eye;

a holding member including a cutting blade and a clamping portion, the cutting blade being configured to cut the upper thread, and the clamping portion being configured to clamp and hold a thread end of the cut upper thread; and a movement mechanism configured to move the holding member to a first position and a second position, the first position being a position in which the holding member protrudes in a first direction from an exterior member of the sewing machine and is located diagonally above and on a side in the first direction of the sewing needle, the first direction being a direction from the standby position to the operative position, the second position being a position located at a side in a second direction with respect to the first position, and the second direction being a direction opposite to the first direction, wherein the sewing machine is configured to receive a selection of a first mode and a second mode, the first mode being a mode in which embroidery sewing is performed while the sewing machine automatically moves an embroidery frame with respect to the sewing needle moving up and down, the embroidery frame being configured to hold a work cloth, and the second mode being a mode in which sewing is performed while a user manually moves the work cloth, and the movement mechanism is configured to move the holding member to the second position in the second mode.

2. The sewing machine according to claim 1, further comprising:

a single motor configured to drive the threading mechanism and the movement mechanism.

3. The sewing machine according to claim 1, wherein the movement mechanism is configured to move the holding member from the second position to the first position in conjunction with a movement of the hook in the first direction, and the movement mechanism is configured to move the holding member from the first position to the second position in conjunction with a movement of the hook in the second direction.

4. The sewing machine according to claim 1, wherein the cutting blade and the clamping portion are provided on a leading end portion of the holding member, a base end portion of the holding member is swingably supported by a machine frame of the sewing machine, the base end portion being on an opposite side to the leading end portion, and the movement mechanism being configured to swing the holding member between the first position and the second position.

5. The sewing machine according to claim 1, wherein the cutting blade and the clamping portion are provided on a leading end portion of the holding member, a base end portion of the holding member is supported by a machine frame of the sewing machine, the base end portion being on an opposite side to the leading end portion, the movement mechanism includes an operation member configured to be operated by a user, and the movement mechanism is configured to move the holding member between the first position and the second position, in accordance with an operation of the operation member by the user.

6. The sewing machine according to claim 1, wherein the movement mechanism is configured to move the holding member to the first position, the second position, and a third position, the third position being a position further to the side in the second direction than the second position, the third position being a position in which the holding member is stored in a recessed portion provided in the exterior member, and the holding member being configured such that, in the third position, the upper thread is uncuttable by the cutting blade.

7. A sewing machine comprising:

a threading mechanism configured to move a hook between a standby position before the hook is passed through an eye of a sewing needle and an operative position after the hook is passed through the eye, the hook being configured to pass an upper thread through the eye;

a holding member including a clamping portion configured to clamp and hold a thread end of the upper thread; and a movement mechanism configured to move the holding member to a first position and a second position, the first position being a position in which the clamping portion protrudes in a first direction from an exterior member of the sewing machine, the clamping portion being configured to hold the upper thread when the holding member is in the first position, the second position being a position located at a side in a second direction with respect to the first position, the first direction being a direction from the standby position to the operative position, and the second direction being a direction opposite to the first direction, wherein:

the sewing machine is configured to receive a selection of a first mode and a second mode, the first mode being a mode in which embroidery sewing is performed while the sewing machine automatically moves an embroidery frame with respect to the sewing needle moving up and down, the embroidery frame being configured to hold a work cloth, and the second mode being a mode in which sewing is performed while a user manually moves the work cloth, and the movement mechanism is configured to move the holding member to the second position in the second mode.

8. The sewing machine according to claim 7, wherein the movement mechanism is configured to move the holding member from the second position to the first position in conjunction with a movement of the hook in the first direction, and the movement mechanism is configured to move the holding member from the first position to the second position in conjunction with a movement of the hook in the second direction.

9. A sewing machine comprising:

a threading mechanism configured to move a hook between a standby position before the hook is passed through an eye of a sewing needle and an operative position after the hook is passed through the eye, the hook being configured to pass an upper thread through the eye;

a holding member including a clamping portion configured to clamp and hold a thread end of the upper thread;

a movement mechanism configured to move the holding member to a first position and a second position, a first direction being a direction from the standby position to the operative position, the second position being a position located at a side in a second direction with respect to the first position, and the second direction being a direction opposite to the first direction; and a single motor configured to drive the threading mechanism and the movement mechanism.

10. The sewing machine according to claim 9, wherein the movement mechanism is configured to move the holding member from the second position to the first position in conjunction with a movement of the hook in the first direction, and the movement mechanism is configured to move the holding member from the first position to the second position in conjunction with a movement of the hook in the second direction.

11. The sewing machine according to claim 9, wherein the sewing machine is configured to receive a selection of a first mode and a second mode, the first mode being a mode in which embroidery sewing is performed while the sewing machine automatically moves an embroidery frame with respect to the sewing needle moving up and down, the embroidery frame being configured to hold a work cloth, and the second mode being a mode in which sewing is performed while a user manually moves the work cloth, and the movement mechanism is configured to move the holding member to the second position in the second mode.

* * * * *